US006966955B2

(12) United States Patent
Choi et al.

(10) Patent No.: US 6,966,955 B2
(45) Date of Patent: Nov. 22, 2005

(54) STEEL PLATE HAVING TIN+ZRN PRECIPITATES FOR WELDED STRUCTURES, METHOD FOR MANUFACTURING SAME AND WELDED STRUCTURE MADE THEREFROM

(75) Inventors: Hae-Chang Choi, Pohang-si (KR); Hong-Chul Jeong, Pohang-si (KR)

(73) Assignee: Posco (KR)

( * ) Notice: Subject to any disclaimer, the term of this patent is extended or adjusted under 35 U.S.C. 154(b) by 76 days.

(21) Appl. No.: 10/203,740

(22) PCT Filed: Nov. 21, 2001

(86) PCT No.: PCT/KR01/01997

§ 371 (c)(1),
(2), (4) Date: Aug. 13, 2002

(87) PCT Pub. No.: WO02/48417

PCT Pub. Date: Jun. 20, 2002

(65) Prior Publication Data

US 2003/0121577 A1 Jul. 3, 2003

(30) Foreign Application Priority Data

Dec. 14, 2000 (KR) ..... 2000-76393
Dec. 15, 2000 (KR) ..... 2000-76827

(51) Int. Cl.[7] ..... C22C 38/14; C22C 38/28; C21D 8/00

(52) U.S. Cl. ..... 148/328; 148/333; 148/334; 148/335; 148/336; 148/654; 148/330; 428/682; 428/683

(58) Field of Search ..... 148/333–336, 148/320, 328, 654; 428/682, 683

(56) References Cited

U.S. PATENT DOCUMENTS 3,904,447 A * 9/1975 Gondo et al. ..... 148/506

FOREIGN PATENT DOCUMENTS

| | | | |
|---|---|---|---|
| JP | 52-017314 | A | 2/1977 |
| JP | 58-031065 | A | 2/1983 |
| JP | 60-245768 | A | 12/1985 |
| JP | 61-079745 | A | 4/1986 |
| JP | 64-015320 | A | 1/1989 |
| JP | 01-176016 | A | 7/1989 |
| JP | 02-125812 | A | 5/1990 |
| JP | 05-186848 | A | 7/1993 |
| JP | 06-010040 | A | 1/1994 |
| JP | 07-076751 | A | 3/1995 |
| JP | 08-060292 | A | 3/1996 |
| JP | 09-194990 | A | 7/1997 |
| JP | 09-324238 | A | 12/1997 |
| JP | 10-298706 | A | 11/1998 |
| JP | 10-298708 | A | 11/1998 |
| JP | 11-140582 | A | 5/1999 |
| JP | 11-293382 | A | 10/1999 |
| JP | 2000-226633 | A | 8/2000 |

OTHER PUBLICATIONS

Nakanishi, Mutsuo et al., "Improvement of Welded HAZ Toughness by Dispersion with Nitride Particles and Oxide Particles", *Journal of Japanese Welding Society*, vol. 52, No. 2, p. 49 (1983).

* cited by examiner

*Primary Examiner*—Deborah Yee
(74) *Attorney, Agent, or Firm*—Webb Ziesenheim Logsdon Orkin & Hanson, P.C.

(57) ABSTRACT

A weldable structural steel product having TiN and ZrN precipitates, which contains, in terms of percent by weight, 0.03 to 0.17% C, 0.01 to 0.5% Si, 0.4 to 2.0% Mn, 0.005 to 0.2% Ti, 0.0005 to 0.1% Al, 0.001 to 0.03% Zr, 0.008 to 0.030% N, 0.0003 to 0.01% B, 0.001 to 0.2% W, at most 0.03% P, at most 0.03% S, at most 0.01% O, and balance Fe and incidental impurities while satisfying conditions of $1.2 \leqq Ti/N \leqq 2.5$, $0.3 \leqq Zr/N \leqq 2.0$, $10 \leqq N/B \leqq 40$, $2.5 \leqq Al/N \leqq 7$, and $6.8 \leqq (Ti+Zr+2Al+4B)/N \leqq 17$, and having a microstructure essentially consisting of a complex structure of ferrite and pearlite having a grain size of 20 $\mu$m or less.

23 Claims, No Drawings

STEEL PLATE HAVING TIN+ZRN PRECIPITATES FOR WELDED STRUCTURES, METHOD FOR MANUFACTURING SAME AND WELDED STRUCTURE MADE THEREFROM

BACKGROUND OF THE INVENTION

1. Field of the Invention

The present invention relates to a structural steel product suitable for use in building construction, bridges, ship construction, marine structures, steel pipes, line pipes, etc. More particularly, the present invention relates to a weldable structural steel product which is manufactured using TIN precipitates and ZrN precipitates, thereby being capable of simultaneously exhibiting improved toughness and strength in a heat-affected zone of the weld. The present invention also relates to a method for manufacturing the weldable structural steel product, and a welded construction using the weldable structural steel product.

2. Description of the Prior Art

Recently, as the height or size of buildings and other structures has increased, steel products having an increased size have been increasingly used. That is, thick steel products have been increasingly used. In order to weld such thick steel products, it is necessary to use a welding process with a high efficiency. For welding techniques for thick steel products, a heat-input submerged welding process enabling a single pass welding, and an electro-welding process have been widely used. The heat-input welding process enabling a single pass welding is also applied to ship constructions and bridges requiring welding of steel plates having a thickness of 25 mm or more. Generally, it is possible to reduce the number of welding passes at a higher amount of heat input because the amount of welded metal is increased.

Accordingly, there may be an advantage in terms of welding efficiency where the heat-input welding process is applicable. That is, in the case of a welding process using an increased heat input, its application can be widened. Typically, the heat input used in the welding process is in the range of 100 to 200 kJ/cm. In order to weld steel plates further thickened to a thickness of 50 mm or more, it is necessary to use super-high heat input ranging from 200 kJ/cm to 500 kJ/cm.

Where high heat input is applied to a steel product, the heat affected zone, in particular, its portion arranged near a fusion boundary, is heated to a temperature approximate to a melting point of the steel product by welding heat input. As a result, growth of grains occurs at the heat affected zone, so that a coarsened grain structure is formed. Furthermore, when the steel product is subjected to a cooling process, fine structures having degraded toughness, such as bainite and martensite, may be formed. Thus, the heat affected zone may be a site exhibiting degraded toughness.

In order to secure a desired stability of such a welding structure, it is necessary to suppress the growth of austenite grains at the heat affected zone, so to allow the welding structure to maintain a fine structure. Known as means for meeting this requirement are techniques in which oxides stable at a high temperature or Ti-based carbon nitrides are appropriately dispersed in steels in order to delay growth of grains at the geat affected zone during a welding process. Such techniques are disclosed in Japanese Patent Laid-open Publication No. Hei. 12-226633, Hie. 11-140582, Hie. 10-298708, Hie. 10-298706, Hie, 9-194990, Hie. 9-324238, Hie. 8-60292, Sho. 60-245768, Hie. 5-186848, Sho. 58-31065, Sho. 61-79745, and Sho. 64-15320, and Journal of Japanese Welding Society, Vol. 52, No. 2, pp 49.

The technique disclosed in Japanese Patent Laid-open Publication No. Hei. 11-140582 is a representative one of techniques using precipitates of TiN. This technique has proposed structural steels exhibiting an impact toughness of about 200 J at 0° C. (in the case of a matrix, about 300 J). In accordance with this technique, the ratio of Ti/N is controlled to be 4 to 12, so as to form TiN precipitates having a grain size of 0.05 $\mu$m or less at a density of $5.8\times10^3/mm^2$ to $8.1\times10^4/mm^2$ while forming TiN precipitates having a grain size of 0.03 to 0.2 $\mu$m at a density of $3.9\times10^3/mm^2$ to $6.2\times10^4/mm^2$, thereby securing a desired toughness at the welding site. In accordance with this technique, however, both the matrix and the heat affected zone exhibit substantially low toughness where a heat-input welding process is applied. For example, the matrix and heat affected zone exhibit impact toughness of 320 J and 220 J at 0° C. Furthermore, since there is a considerable toughness difference between the matrix and heat affected zone, as much as about 100 J, it is difficult to secure a desired reliability for a steel construction obtained by subjecting thickened steel products to a welding process using super-high heat input. Moreover, in order to obtain desired TiN precipitates, the technique involves a process of heating a slab at a temperature of 1,050° C. or more, quenching the heated slab, and again heating the quenched slab for a subsequent hot rolling process. Due to such a double heat treatment, an increase in the manufacturing costs occurs.

Japanese Patent Laid-open Publication No. Hei. 9-194990 discloses a technique in which the ratio between Al and O in low steel ($N\leqq0.005\%$) is controlled to be within a range of 0.3 to 1.5 ($0.3\leqq Al/O\leqq1.5$) in order to form a complex oxide containing Al, Mn, and Si. However, the steel product according to this technique exhibits a degraded toughness because when employing a welding process using a high heat input of about 100 kJ/cm, the transition temperature at the heat affected zone corresponds to a level of about −50. Also, Japanese Patent Laid-open Publication No. Hei. 10-298708 discloses a technique in which complex precipitates of MgO and TiN are utilized. However, the steel product according to this technique exhibits a degraded toughness in that when a welding process using a high heat input of about 100 kJ/cm, the impact toughness at 0° C. in the heat affected zone corresponds to 130 J.

There have been many techniques for improving the toughness of the heat affected zone using TiN precipitates and Al-based oxides or MgO where a welding process using a high heat input is applied. However, there is no technique capable of remarkably improving the toughness of the heat affected zone where a welding process using a super-high heat input is carried out for a prolonged period of time at 1,350° C. or more.

SUMMARY OF THE INVENTION

DISCLOSURE OF THE INVENTION

Therefore, an object of the invention is to provide a weldable structural steel product capable of minimizing the toughness difference between the matrix and the heat affected zone even within a welding heat input range from an intermediate heat input to a super-high heat input by use of TiN precipitates and ZrN precipitates, while exhibiting a superior toughness in the heat affected zone, a method for manufacturing the weldable structural steel product, and a welded structure using the weldable structural steel product.

In accordance with one aspect, the present invention provides a welding structural steel product having TiN and ZrN precipitates, comprising, in terms of percent by weight, 0.03 to 0.17% C, 0.01 to 0.5% Si, 0.4 to 2.0% Mn, 0.005 to 0.2% Ti, 0.0005 to 0.1% Al, 0.001 to 0.03% Zr, 0.008 to 0.030% N, 0.0003 to 0.01% B, 0.001 to 0.2% W, at most 0.03% P, at most 0.03% S, at most 0.01% O, and balance Fe and incidental impurities while satisfying conditions of $1.2 \leqq Ti/N \leqq 2.5$, $0.3 \leqq Zr/N \leqq 2.0$, $10 \leqq N/B \leqq 40$, $2.5 \leqq Al/N \leqq 7$, and $6.8 \leqq (Ti+Zr+2Al+4B)/N \leqq 17$, and having a microstructure essentially consisting of a complex structure of ferrite and pearlite having a grain size of 20 $\mu$m or less.

In accordance with another aspect, the present invention provides a method for manufacturing a weldable structural steel product having fine complex precipitates of TiN and ZrN, comprising the steps of:

preparing a steel slab containing, in terms of percent by weight, 0.03 to 0.17% C, 0.01 to 0.5% Si, 0.4 to 2.0% Mn, 0.005 to 0.2% Ti, 0.0005 to 0.1% Al, 0.001 to 0.03% Zr, 0.008 to 0.030% N, 0.0003 to 0.01% B, 0.001 to 0.2% W, at most 0.03% P, at most 0.03% S, at most 0.001% O, and balance Fe and incidental impurities while satisfying conditions of $1.2 \leqq Ti/N \leqq 2.5$, $0.3 \leqq Zr/N \leqq 2.0$, $10 \leqq N/B \leqq 40$, $2.5 \leqq Al/N \leqq 7$, and $6.8 \leqq (Ti+Zr+2Al+4B)/N \leqq 17$;

heating the steel slab at a temperature ranging from 1,100° C. to 1,250° C. for 60 to 180 minutes;

hot rolling the heated steel slab in an austenite recrystallization range at a thickness reduction rate of 40% or more; and cooling the hot-rolled steel slab at a rate of 1° C./min to a temperature corresponding to ±10° C. from a ferrite transformation finish temperature.

In accordance with another aspect, the present invention provides a method for manufacturing a weldable structural steel product having fine complex precipitates of TIN and ZrN, comprising the steps of:

preparing a steel slab containing, in terms of percent by weight, 0.03 to 0.17% C, 0.01 to 0.5% Si, 0.4 to 2.0% Mn, 0.005 to 0.2% Ti, 0.0005 to 0.1% Al, 0.001 to 0.03% Zr, at most 0.005% N, 0.0003 to 0.01% B, 0.001 to 0.2% W, at most 0.03% P, 0.003 to 0.05% S, at most 0.01% O, and balance Fe and incidental impurities;

heating the steel slab at a temperature ranging from 1,000° C. to 1,250° C. for 60 to 180 minutes while nitrogenizing the steel slab to control the N content of the steel slab to be 0.008 to 0.03%, and to satisfy conditions of $1.2 \leqq Ti/N \leqq 2.5$, $0.3 \leqq Zr/N \leqq 2$, $10 \leqq N/B \leqq 40$, $2.5 \leqq Al/N \leqq 7$, and $6.8 \leqq (Ti+Zr+2Al+4B)/N \leqq 17$;

hot rolling the nitrogenized steel slab in an austenite recrystallization range at a thickness reduction rate of 40% or more; and cooling the hot-rolled steel slab at a rate of 1° C./min to a temperature corresponding to ±10° C. from a ferrite transformation finish temperature.

In accordance with another aspect, the present invention provides a welded structure having a superior heat affected zone toughness, manufactured using a weldable structural steel product according to any one of the above described weldable structural steel products.

DETAILED DESCRIPTION OF THE INVENTION

BEST MODE FOR CARRYING OUT THE INVENTION

Now, the present invention will be described in detail.

In the specification, the term "prior austenite" represents an austenite formed at the heat affected zone in a steel product (matrix) when a welding process using high heat input is applied to the steel product. This austenite is distinguished from the austenite formed in the manufacturing procedure (hot rolling process).

After carefully observing the growth behavior of the prior austenite in the heat affected zone in a steel product (matrix) and the phase transformation of the prior austenite exhibited during a cooling procedure when a welding process using high heat input is applied to the steel product, the inventors found that the heat affected zone exhibits a variation in toughness with reference to the critical grain size of the prior austenite (about 80 $\mu$m), and that the toughness at the heat affected zone is increased at an increased fraction of fine ferrite.

On the basis of such an observation, the present invention is characterized by:

[1] utilizing TiN precipitates and ZrN precipitates in the steel product (matrix);

[2] reducing the grain size of initial ferrite in the steel product to a critical level or less so as to control the prior austenite to have a grain size of about 80 $\mu$m or less; and

[3] reducing the ratio of Ti/N to effectively form BN and AlN precipitates, thereby increasing the fraction of ferrite at the heat affected zone while controlling the ferrite to have an acicular or polygonal structure effective to achieve an improvement in toughness.

The above features [1], [2], [3] of the present invention will be described in detail.

[1] TiN Precipitates and ZrN Precipitates

Where a high heat-input welding is applied to a structural steel product, the heat affected zone near a fusion boundary is heated to a high temperature of about 1,400° C. or more. As a result, TiN precipitated in the matrix is partially dissolved due to the weld heat. Otherwise, an Ostwald ripening phenomenon occurs. That is, precipitates having a small grain size are dissolved, so that they are diffused in the form of precipitates having a larger grain size. In accordance with the Ostwald ripening phenomenon, a part of the precipitates are coarsened. Furthermore, the density of TiN precipitates is considerably reduced, so that the effect of suppressing growth of prior austenite grains disappears.

After observing a variation in the characteristics of TiN precipitates depending on the ratio of Ti/N while taking into consideration the fact that the above phenomenon may be caused by diffusion of Ti atoms occurring when TiN precipitates dispersed in the matrix are dissolved by the welding heat, the inventors discovered that under a high nitrogen concentration condition (that is, a low Ti/N ratio), the concentration and diffusion rate of dissolved Ti atoms is reduced, and an improved high-temperature stability of TiN precipitates is obtained. That is, when the ratio between Ti and N (Ti/N) ranges from 1.2 to 2.5, the amount of dissolved Ti is greatly reduced, thereby causing TiN precipitates to have an increased high-temperature stability. As a result, fine TiN precipitates are uniformly dispersed at a high density. Such a surprising result was assumed to be based on the fact that the solubility product representing the high-temperature stability of TiN precipitates is reduced at a reduced content of nitrogen, because when the content of nitrogen is increased under the condition in which the content of Ti is constant, all dissolved Ti atoms are easily coupled with nitrogen atoms, and the amount of dissolved Ti is reduced under a high nitrogen concentration condition.

Also, the inventors discovered that a large amount of fine TiN precipitates and ZrN precipitates can be formed by controlling ratios of Ti/N and Zr/N in a high-nitrogen environment. These ZrN precepitates are effective to suppress growth of prior austenite because they are stable at a high temperature. After observing variations in respective sizes, amounts, and densities of TiN precipitates and ZrN precipitates depending on the ratios of Ti and N (Ti/N) and of Zr and N (Zr/N), the inventors found that TiN precipitates having a grain size of 0.01 to 0.1 $\mu$m are formed at a density of $1.0\times10^7/mm^2$ or more under the condition in which the ratio of Ti/N is 1.2 to 2.5, and the ratio of Zr/N is 0.3 to 2.0. That is, the precipitates had a uniform spacing of about 0.5 $\mu$m. Also, ZrN precipitates were formed.

The inventors also discovered an interesting fact. That is, even when a high-nitrogen steel is manufactured by producing, from a steel slab, a low-nitrogen steel having a nitrogen content of 0.005% or less to exhibit a low possibility of generation of slab surface cracks, and then subjecting the low-nitrogen steel to a nitrogenizing (nitriding) treatment in a slab heating furnace, it is possible to obtain desired TiN precipitates as defined above, in so far as the ratio of Ti/N is controlled to be 1.2 to 2.5. This was analyzed to be based on the fact that when an increase in nitrogen content is made in accordance with a nitrogenizing (nitriding) treatment under the condition in which the content of Ti is constant, all dissolved Ti atoms are easily rendered to be coupled with nitrogen atoms, thereby reducing the solubility product of TiN representing the high-temperature stability of TIN precipitates.

In accordance with the present invention, in addition to the control of the ratio of Ti/N, respective ratios of Zr/N, N/B, Al/N, and V/N, the content of N, and the total content of Ti+Al+B+(V) are generally controlled to precipitate N in the form of ZrN, BN, AlN, and VN, taking into consideration the fact that promoted aging may occur due to the presence of dissolved N under a high-nitrogen environment. In accordance with the present invention, as described above, the toughness difference between the matrix and the heat affected zone is minimized by not only controlling the density of TiN precipitates depending on the ratio of Ti/N and the solubility product of TiN, but also dispersing ZrN. This scheme is considerably different from the conventional precipitate control scheme (Japanese Patent Laid-open Publication No. Hei. 11-140582) in which the amount of TiN precipitates is increased by simply increasing the content of Ti.

[2] Control for Ferrite Grain Size of Steels (Matrix)

After research, the inventors found that in order to control prior austenite to have a grain size of about 80 $\mu$m or less, it is important to form fine ferrite grains in a complex structure of ferrite and pearlite, in addition to control of precipitates. Fining of ferrite grains can be achieved by fining austenite grains in accordance with a hot rolling process or controlling growth of ferrite grains occurring during a cooling process following the hot rolling process. In this connection, it was also found that it is very effective to appropriately precipitate carbides (VC and WC) effective to growth of ferrite grains at a desired density.

[3] Microstructure of Heat Affected Zone

The inventors also found that the toughness of the heat affected zone is considerably influenced by not only the size of prior austenite grains, but also the amount and shape of ferrite precipitated at the grain boundary of the prior austenite when the matrix is heated to a temperature of 1,400° C. In particular, it is preferable to generate a transformation of polygonal ferrite or acicular ferrite in austenite grains. For this transformation, AlN and BN precipitates are utilized in accordance with the present invention.

The present invention will now be described in conjunction with respective components of a steel product to be manufactured, and a manufacturing method for the steel product.

Weldable Structural Steel Product

First, the composition of the weldable structural steel product according to the present invention will be described.

In accordance with the present invention, the content of carbon (C) is limited to a range of 0.03 to 0.17 weight % (hereinafter, simply referred to as "%").

Where the content of carbon (C) is less than 0.03%, it is impossible to secure a sufficient strength for structural steels. On the other hand, where the C content exceeds 0.17%, transformation of weak-toughness microstructures such as upper bainite, martensite, and degenerate pearlite occurs during a cooling process, thereby causing the structural steel product to exhibit a degraded low-temperature impact toughness. Also, an increase in the hardness or strength of the welding site occurs, thereby causing a degradation in toughness and generation of welding cracks.

The content of silicon (Si) is limited to a range of 0.01 to 0.5%.

At a silicon content of less than 0.01%, it is impossible to obtain a sufficient deoxidizing effect of molten steel in the steel manufacturing process. In this case, the steel product also exhibits a degraded corrosion resistance. On the other hand, where the silicon content exceeds 0.5%, a saturated deoxidizing effect is exhibited. Also, transformation of island-like martensite is promoted due to an increase in hardenability occurring in a cooling process following a rolling process. As a result, a degradation in low-temperature impact toughness occurs.

The content of manganese (Mn) is limited to a range of 0.4 to 2.0%.

Mn has an effective function for improving the deoxidizing effect, weldability, hot workability, and strength of steels. The Mn element forms a substitutional solid solution in a matrix, thereby solid-solution strengthening the matrix to secure desired strength and toughness. In order to obtain such effects, it is desirable for Mn to be contained in the composition in a content of 0.4% or more. However, where the Mn content exceeds 2.0%, there is no increased solid-solution strengthening effect. Rather, segregation of Mn is generated, which causes a structural non-uniformity adversely affecting the toughness of the heat affected zone. Also, macroscopic segregation and microscopic segregation occur in accordance with a segregation mechanism in a solidification procedure of steels, thereby promoting formation of a central segregation band in the matrix in a rolling process. Such a central segregation band serves as a cause for forming a central low-temperature transformed structure in the matrix.

In particular, Mn is precipitated in the form of MnS around Ti-based oxides, so that it influences formation of acicular and polygonal ferrites effective to improve the toughness of the heat affected zone.

The content of titanium (Ti) is limited to a range of 0.005 to 0.2%.

Ti is an essential element in the present invention because it is coupled with N to form fine TiN precipitates stable at a high temperature. In order to obtain such an effect of precipitating fine TiN grains, it is desirable to add Ti in an amount of 0.005% or more. However, where the Ti content exceeds 0.2%, coarse TiN precipitates and Ti oxides may be formed in molten steel. In this case, it is impossible to suppress the growth of prior austenite grains in the heat affected zone.

The content of aluminum (Al) is limited to a range of 0.0005 to 0.1%.

Al is an element which is not only necessarily used as a deoxidizer. Al also reacts with oxygen to form an Al oxide, thereby preventing Ti from reacting with oxygen. Thus, Al aids Ti to form fine TiN precipitates. Al is also effective to form fine AlN precipitates in steels. In order to form fine AlN precipitates, Al is preferably added in an amount of 0.0005% or more. However, when the content of Al exceeds 0.1%, dissolved Al remaining after precipitation of AlN promotes formation of Widmanstatten ferrite and island-like martensite exhibiting weak toughness in the heat affected zone in a cooling process. As a result, a degradation in the toughness of the heat affected zone occurs where a high heat input welding process is applied.

The content of zirconium (Zr) is limited to a range of 0.001 to 0.03%.

Zr is an essential element in the present invention because it is coupled with N to form fine ZrN precipitates stable at a high temperature. In order to obtain such an effect of precipitating fine ZrN grains, it is desirable to add Zr in an amount of 0.001% or more. However, where the Zr content exceeds 0.03%, coarse ZrN precipitates and Zr oxides may be formed in molten steel. In this case, adverse effects on the toughness of the matrix and heat affected zone are generated.

The content of nitrogen (N) is limited to a range of 0.008 to 0.03%.

N is an element essentially required to form TiN, ZrN, AlN, BN, VN, NbN, etc. N serves to suppress, as much as possible, the growth of prior austenite grains in the heat affected zone when a high heat input welding process is carried out, while increasing the amount of precipitates such as TiN, ZrN, AlN, BN, VN, NbN, etc. The N content is determined to be 0.008% or more because N considerably affects the grain size, spacing, and density of TiN and ZrN precipitates, the frequency of those precipitates to form complex precipitates with oxides, and the high-temperature stability of those precipitates. However, when the N content exceeds 0.03%, such effects are saturated. In this case, a degradation in toughness occurs due to an increased amount of dissolved nitrogen in the heat affected zone. Furthermore, the surplus N may be included in the welding metal in accordance with a dilution occurring in the welding process, thereby causing a degradation in the toughness of the welding metal.

Alternatively, the slab used in accordance with the present invention may be a low-nitrogen steel which may be subsequently subjected to a nitriding or nitrogenizing treatment to form a high-nitrogen steel. In this case, the slab is controlled to have an N content of 0.005% in order to exhibit a low possibility of generation of slab surface cracks. The slab is then subjected to a re-heating process involving a nitriding/nitrogenizing treatment, so as to manufacture a high-nitrogen steel having an N content of 0.008 to 0.03%.

The content of boron (B) is limited to a range of 0.0003 to 0.01%.

B is an element which is very effective to form acicular ferrite exhibiting a superior toughness in grain boundaries while forming polygonal ferrites in the grain boundaries. B forms BN precipitates, thereby suppressing the growth of prior austenite grains. Also, B forms Fe boron carbides in grain boundaries and within grains, thereby promoting transformation into acicular and polygonal ferrites exhibiting a superior toughness. It is impossible to expect such effects when the B content is less than 0.0003%. On the other hand, when the B content exceeds 0.01%, an increase in hardenability may undesirably occur, so that there may be possibilities of hardening the heat affected zone, and generating low-temperature cracks.

The content of tungsten (W) is limited to a range of 0.001 to 0.2%.

When tungsten is subjected to a hot rolling process, it is uniformly precipitated in the form of tungsten carbides (WC) in the matrix, thereby effectively suppressing growth of ferrite grains after ferrite transformation. Tungsten also serves to suppress the growth of prior austenite grains at the initial stage of a heating process for the heat affected zone. Where the tungsten content is less than 0.001%, the tungsten carbides serving to suppress the growth of ferrite grains during a cooling process following the hot rolling process are dispersed at an insufficient density. On the other hand, where the tungsten content exceeds 0.2%, the effect of tungsten is saturated.

Respective contents of phosphorous (P) and sulfur (S) are limited to 0.030% or less.

Since P is an impurity element causing central segregation in a rolling process and formation of high-temperature cracks in a welding process, it is desirable to control the content of P to be as low as possible. In order to achieve an improvement in the toughness of the heat affected zone and a reduction in central segregation, it is desirable for the P content to be 0.03% or less.

It is desirable to control the content of S to be as low as possible because a low-melting point compound such as FeS may be formed at a high S content. Preferably, the S content is 0.03% or less in order to improve the toughness of the matrix and the toughness of the heat affected zone while reducing central segregations. S is precipitated around Ti-based oxides in the form of MnS, so that it influences the formation of acicular and polygonal ferrites effective to achieve an improvement in the toughness of the heat affected zone. Accordingly, the S content is more preferably within a range of 0.003 to 0.03%, taking into consideration high-temperature welding cracks.

The content of oxygen (O) is limited to 0.01% or less.

Where the content of O exceeds 0.01%, Ti forms Ti oxides in molten steels, so that it cannot form TiN precipitates. Accordingly, it is undesirable for the O content to be more than 0.005%. Furthermore, inclusions such as coarse Fe oxides and Zr oxides may be formed which undesirably affect the toughness of the matrix.

In accordance with the present invention, the ratio of Ti/N is limited to a range of 1.2 to 2.5.

When the ratio of Ti/N is limited to a desired range as defined above, there are two advantages as follows.

First, it is possible to increase the density of TiN precipitates while uniformly dispersing those TiN precipitates. That is, when the nitrogen content is increased under the condition in which the Ti content is constant, all dissolved Ti atoms are easily coupled with nitrogen atoms in a continuous casting process (in the case of a high-nitrogen slab) or in a cooling process following a nitrogenizing treatment (in the case of a low-nitrogen slab), so that fine TiN precipitates are formed while being dispersed at an increased density.

Second, the solubility product of TiN representing the high-temperature stability of TiN precipitates is reduced, thereby preventing a re-dissolution of Ti. That is, Ti predominantly exhibits a property of coupling with N under a high-nitrogen environment, over a dissolution property. Accordingly, TiN precipitates are stable at a high temperature.

Therefore, the ratio of Ti/N is controlled to be 1.2 to 2.5 in accordance with the present invention. When the Ti/N ratio is less than 1.2, the amount of nitrogen dissolved in the matrix is increased, thereby degrading the toughness of the heat affected zone. On the other hand, when the Ti/N ratio is more than 2.5, coarse TiN grains are formed. In this case, it is difficult to obtain a uniform dispersion of TiN. Furthermore, the surplus Ti remaining without being precipitated in the form of TiN is present in a dissolved state, so that it may adversely affect the toughness of the heat affected zone.

The ratio of Zr/N is limited to a range of 0.3 to 2.0.

When the ratio of Zr/N is less than 0.3, ZrN serving to prevent growth of grains in the heat affected zone in a welding process is precipitated in an insufficient amount. On the other hand, when the ratio of Zr/N exceeds 2.0, the effect of ZrN is saturated, thereby degrading the toughness of the heat affected zone.

The ratio of N/B is limited to a range of 10 to 40.

When the ratio of N/B is less than 10, BN serving to promote a transformation into polygonal ferrites at the grain boundaries of prior austenite is precipitated in an insufficient amount in the cooling process following the welding process. On the other hand, when the N/B ratio exceeds 40, the effect of BN is saturated. In this case, an increase in the amount of dissolved nitrogen occurs, thereby degrading the toughness of the heat affected zone.

The ratio of Al/N is limited to a range of 2.5 to 7.

Where the ratio of Al/N is less than 2.5, AlN precipitates for causing a transformation into acicular ferrites are dispersed at an insufficient density. Furthermore, an increase in the amount of dissolved nitrogen in the heat affected zone occurs, thereby possibly causing formation of welding cracks. On the other hand, where the Al/N ratio exceeds 7, the effects obtained by controlling the Al/N ratio are saturated.

The ratio of (Ti+Zr+2Al+4B)/N is limited to a range of 6.8 to 17.

Where the ratio of (Ti+Zr+2Al+4B)/N is less than 6.8, the grain size and density of TiN, ZrN, AlN, BN, and VN precipitates are insufficient, so that it is impossible to achieve suppression of the growth of prior austenite grains in the heat affected zone, formation of fine polygonal ferrite at grain boundaries, control of the amount of dissolved nitrogen, formation of acicular ferrite and polygonal ferrite within grains, and control of structure fractions. On the other hand, when the ratio of (Ti+Zr+2Al+4B)/N exceeds 17, the effects obtained by controlling the ratio of (Ti+Zr+2Al+4B)/N are saturated. Where V is added, it is preferable for the ratio of (Ti+Zr+2Al+4B+V)/N to range from 7 to 19.

In accordance with the present invention, V may also be selectively added to the above defined steel composition.

V is an element which is coupled with N to form VN, thereby promoting formation of ferrite in the heat affected zone. VN is precipitated alone, or precipitated in TiN precipitates, so that it promotes a ferrite transformation. Also, V is coupled with C, thereby forming a carbide, that is, VC. This VC serves to suppress growth of ferrite grains after the ferrite transformation.

Thus, V further improves the toughness of the matrix and the toughness of the heat affected zone. In accordance with the present invention, the content of V is preferably limited to a range of 0.01 to 0.2%. Where the content of V is less than 0.01%, the amount of precipitated VN is insufficient to obtain an effect of promoting the ferrite transformation in the heat affected zone. On the other hand, where the content of V exceeds 0.2%, both the toughness of the matrix and the toughness of the heat affected zone are degraded. In this case, an increase in welding hardenability occurs. For this reason, there is a possibility of formation of undesirable low-temperature welding cracks.

Where V is added, the ratio of V/N is preferably controlled to be 0.3 to 9.

When the ratio of V/N is less than 0.3, it may be difficult to secure an appropriate density and grain size of VN precipitates dispersed at boundaries of complex precipitates of TiN and MnS for an improvement in the toughness of the heat affected zone. On the other hand, when the ratio of V/N exceeds 9, the VN precipitates dispersed at the boundaries of complex precipitates of TiN and MnS may be coarsened, thereby reducing the density of those VN precipitates. As a result, the fraction of ferrite effectively serving to improve the toughness of the heat affected zone may be reduced.

In order to further improve mechanical properties, the steels having the above defined composition may be added with one or more element selected from the group consisting of Ni, Cu, Nb, Mo, and Cr in accordance with the present invention.

The content of Ni is preferably limited to a range of 0.1 to 3.0%.

Ni is an element which is effective to improve the strength and toughness of the matrix in accordance with a solid-solution strengthening. In order to obtain such an effect, the Ni content is preferably 0.1% or more. However, when the Ni content exceeds 3.0%, an increase in hardenability occurs, thereby degrading the toughness of the heat affected zone. Furthermore, there is a possibility of formation of high-temperature cracks in both the heat affected zone and the matrix.

The content of copper (Cu) is limited to a range of 0.1 to 1.5%.

Cu is an element which is dissolved in the matrix, thereby solid-solution strengthening the matrix. That is, Cu is effective to secure desired strength and toughness for the matrix. In order to obtain such an effect, Cu should be added in a content of 0.1% or more. However, when the Cu content exceeds 1.5%, the hardenability of the heat affected zone is increased, thereby causing a degradation in toughness. Furthermore, formation of high-temperature cracks at the heat affected zone and welding metal is promoted. In particular, Cu is precipitated in the form of CuS around Ti-based oxides, along with S, thereby influencing the formation of ferrites having an acicular or polygonal structure effective to achieve an improvement in the toughness of the heat affected zone. Accordingly, it is preferred for the Cu content to be 0.1 to 1.5%.

Where Cu is added along with Ni, the total content of these elements is preferably 3.5% or less. Where the total content of Cu and Ni exceeds 3.5%, an increase in hardenability occurs, thereby adversely affecting the toughness and weldability of the heat affected zone.

The content of Nb is preferably limited to a range of 0.01 to 0.10%.

Nb is an element which is effective to secure a desired strength of the matrix. For such an effect, Nb is added in an amount of 0.01% or more. However, when the content of Nb exceeds 0.1%, coarse NbC may be precipitated alone, adversely affecting the toughness of the matrix.

The content of chromium (Cr) is preferably limited to a range of 0.05 to 1.0%.

Cr serves to increase hardenability while improving strength. At a Cr content of less than 0.05%, it is impossible to obtain desired strength. On the other hand, when the Cr content exceeds 1.0%, a degradation in toughness in both the matrix and the heat affected zone occurs.

The content of molybdenum (Mo) is preferably limited to a range of 0.05 to 1.0%.

Mo is an element which increases hardenability while improving strength. In order to secure desired strength, it is necessary to add Mo in an amount of 0.05% or more. However, the upper limit of the Mo content is determined to be 0.1%, similarly to Cr, in order to suppress hardening of the heat affected zone and formation of low-temperature welding cracks.

In accordance with the present invention, one or both of Ca and REM may also be added in order to suppress the growth of prior austenite grains in a heating process.

Ca and REM serve to form an oxide exhibiting a superior high-temperature stability, thereby suppressing the growth of prior austenite grains in the matrix during a heating process while improving the toughness of the heat affected zone. Also, Ca has an effect of controlling the shape of coarse MnS in a steel manufacturing process. For such effects, Ca is preferably added in an amount of 0.0005% or more, whereas REM is preferably added in an amount of 0.005% or more. However, when the Ca content exceeds 0.005%, or the REM content exceeds 0.05%, large-size inclusions and clusters are formed, thereby degrading the cleanness of steels. For REM, one or more of Ce, La, Y, and Hf may be used to obtain the above described effects.

Now, the microstructure of the weldable structural steel product according to the present invention will be described.

Preferably, the microstructure of the weldable structural steel product according to the present invention is a complex structure of ferrite and pearlite. Also, the ferrite preferably has a grain size of 20 $\mu$m or less. Where ferrite grains have a grain size of more than 20 $\mu$m, the prior austenite grains in the heat affected zone are rendered to have a grain size of 80 $\mu$m or more when a high heat input welding process is applied, thereby degrading the toughness of the heat affected zone.

Where the fraction of ferrite in the complex structure of ferrite and pearlite is increased, the toughness and elongation of the matrix are correspondingly increased. Accordingly, the fraction of ferrite is determined to be 20% or more, and preferably 70% or more.

Meanwhile, the prior austenite grains in the heat affected zone are considerably influenced by not only the size and density of oxide and nitride grains where the austenite grain size of the matrix is constant. Where a high heat-input welding (at a high temperature of about 1,400° C. or more) is applied to a structural steel product, nitrides dispersed in the matrix are partially dissolved again in the matrix at a rate of 30 to 40%, thereby reducing the effect of suppressing the growth of prior austenite grains.

Thus, it is necessary to disperse nitrides at a density determined taking into consideration the amount of nitrides to be dissolved again in the matrix in a heating process. In accordance with the present invention, fine TiN precipitates are uniformed dispersed to suppress growth of prior austenite in the heat affected zone. Accordingly, it is possible to effectively suppress an Ostwald ripening phenomenon causing coarsening of precipitates.

Preferably, TiN precipitates are uniformly dispersed in the matrix with a spacing of 0.5 $\mu$m or less.

It is desirable that precipitates of TIN having a grain size of 0.01 to 0.1 $\mu$m are dispersed at a density of $1.0\times10^7/mm^2$. Where the precipitates have a grain size of less than 0.01 $\mu$m, they may be easily dissolved again in the matrix in a welding process, so that they cannot effectively suppress the growth of prior austenite grains. On the other hand, where the precipitates have a grain size of more than 0.1 $\mu$m, they exhibit an insufficient pinning effect (suppression of growth of grains) on prior austenite grains, and behave like coarse non-metallic inclusions, thereby adversely affecting mechanical properties. Where the density of the fine precipitates is less than $1.0\times10^7/mm^2$, it is difficult to control the critical austenite grain size of the heat affected zone to be 80 $\mu$m or less where a welding process using high input heat is applied.

Method for Manufacturing Weldable Structural Steel Products

In accordance with the present invention, a steel slab having the above defined composition is first prepared.

The steel slab of the present invention may be manufactured by conventionally processing, through a casting process, molten steel treated by conventional refining and deoxidizing processes. However, the present invention is not limited to such processes.

In accordance with the present invention, molten steel is primarily refined in a converter and tapped into a ladle so that it may be subjected to a "refining outside furnace" process as a secondary refining process. In the case of thick products such as weldable structural steel products, it is desirable to perform a degassing treatment (Ruhrstahl Hereaus (RH) process) after the "refining outside furnace" process. Typically, deoxidization is carried out between the primary and secondary refining processes.

In the deoxidizing process, it is most desirable to add Ti under the condition in which the amount of dissolved oxygen has been controlled not to be more than an appropriate level in accordance with the present invention. This is because most of Ti is dissolved in the molten steel without forming any oxide. In this case, an element having a deoxidizing effect higher than that of Ti is preferably added prior to the addition of Ti.

This will be described in more detail. The amount of dissolved oxygen greatly depends on an oxide production behavior. In the case of deoxidizing agents having a higher oxygen affinity, their rate of coupling with oxygen in molten steel is higher. Accordingly, where a deoxidation is carried out using an element having a deoxidizing effect higher than that of Ti, prior to the addition of Ti, it is possible to prevent Ti from forming an oxide, as much as possible. Of course, a deoxidation may be carried out under the condition that Mn, Si, etc. belonging to the 5 elements of steel are added prior to the addition of the element having a deoxidizing effect higher than that of Ti, for example, Al. After the deoxidation, a secondary deoxidation is carried out using Al. In this case, there is an advantage in that it is possible to reduce the amount of added deoxidizing agents. Respective deoxidizing effects of deoxidizing agents are as follows:

$$Cr<Mn<Si<Ti<Al<REM<Zr<Ca\approx Mg$$

As apparent from the above description, it is possible to control the amount of dissolved oxygen to be as low as possible by adding an element having a deoxidizing effect higher than that of Ti, prior to the addition of Ti, in accordance with the present invention. Preferably, the amount of dissolved oxygen is controlled to be 30 ppm or less. When the amount of dissolved oxygen exceeds 30 ppm, Ti may be coupled with oxygen existing in the molten steel, thereby forming a Ti oxide. As a result, the amount of dissolved Ti is reduced.

It is preferred that after the control of the dissolved oxygen amount, the addition of Ti be completed within 10 minutes under the condition that the content of Ti ranges from 0.005% to 0.2%. This is because the amount of dissolved Ti may be reduced with the lapse of time due to production of a Ti oxide after the addition of Ti.

In accordance with the present invention, the addition of Ti may be carried out at any time before or after a vacuum degassing treatment.

In accordance with the present invention, a steel slab is manufactured using the molten steel prepared as described above. Where the prepared molten steel is low-nitrogen steel (requiring a nitrogenizing treatment), it is possible to carry out a continuous casting process irrespective of its casting speed, that is, a low casting speed or a high casting speed. However, where the molten steel is high-nitrogen steel, it is desirable, in terms of an improvement in productivity, to cast the molten steel at a low casting speed while maintaining a weak cooling condition in the secondary cooling zone, taking into consideration the fact that high-nitrogen steel has a high possibility of formation of slab surface cracks.

Preferably, the casting speed of the continuous casting process is 1.1 m/min lower than a typical casting speed, that is, about 1.2 m/min. More preferably, the casting speed is controlled to be about 0.9 to 1.1 m/min. At a casting speed of less than 0.9 m/min, a degradation in productivity occurs even though there is an advantage in terms of reduction of slab surface cracks. On the other hand, where the casting speed is higher than 1.1 m/min, the possibility of formation of slab surface cracks is increased. Even in the case of low-nitrogen steel, it is possible to obtain a better internal quality when the steel is cast at a low speed of 0.9 to 1.2 m/min.

Meanwhile, it is desirable to control the cooling condition at the secondary cooling zone because the cooling condition influences the fineness and uniform dispersion of TiN precipitates.

For high-nitrogen molten steel, the water spray amount in the secondary cooling zone is determined to be 0.3 to 0.35 l/kg for weak cooling. When the water spray amount is less than 0.3 l/kg, coarsening of TiN precipitates occurs. As a result, it may be difficult to control the grain size and density of TiN precipitates in order to obtain desired effects according to the present invention. On the other hand, when the water spray amount is more than 0.35 l/kg, the frequency of formation of TiN precipitates is too low so that it is difficult to control the grain size and density of TiN precipitates in order to obtain desired effects according to the present invention.

Thereafter, the steel slab prepared as described above is heated in accordance with the present invention.

In the case of a high-nitrogen steel slab having a nitrogen content of 0.008 to 0.030%, it is heated at a temperature of 1,100 to 1,250° C. for 60 to 180 minutes. When the slab heating temperature is less than 1,100° C., there is a problem in that the density of TiN precipitates is insufficient because the diffusion rate of solute atoms is low. On the other hand, when the slab heating temperature is more than 1,250° C., TiN-based precipitates are coarsened or degraded, so that the density of those precipitates is reduced. Meanwhile, where the slab heating time is less than 60 minutes, there is no effect of reducing segregation of solute atoms. Furthermore, diffusion of solute atoms occurs, so that the time for forming precipitates is insufficient. When the heating time exceeds 180 minutes, coarsening of austenite grains occurs. Also, there is a degradation in workability and productivity.

Low-nitrogen steel slabs are subjected to a nitrogenizing (nitriding) treatment in a slab heating furnace to form high-nitrogen steel slabs. During this process, the ratio between Ti and N is controlled. Basically, the effect obtained by the nitrogenizing (nitriding) treatment in the slab heating furnace is to prevent the formation of slab surface cracks involved with high-nitrogen steels. In addition, the following two effects are obtained. That is, it is possible to increase the amount of fine TiN precipitates, and to stabilize the fine TiN precipitates at a high temperature. That is, when the nitrogen content in the matrix is increased at the same Ti content, all Ti atoms are coupled with N atoms during the heat treatment in the slab heating furnace.

For a low-nitrogen steel slab containing nitrogen in an amount of 0.005%, a nitrogenizing treatment is carried out. That is, the low-nitrogen steel slab is preferably heated at a temperature of 1,000 to 1,250° C. for 60 to 180 minutes for the nitrogenizing treatment thereof, in order to control the nitrogen concentration of the slab to be preferably 0.008 to 0.03%. In order to secure an appropriate amount of TiN precipitates in the slab, the nitrogen content should be 0.008% or more. However, when the nitrogen content exceeds 0.03%, nitrogen may be diffused in the slab, thereby causing the amount of nitrogen at the surface of the slab to be more than the amount of nitrogen precipitated in the form of fine TiN precipitates. As a result, the slab is hardened at its surface, thereby adversely affecting the subsequent rolling process.

When the heating temperature of the slab is less than 1,000° C., nitrogen cannot be sufficiently diffused, thereby causing fine TiN precipitates to have a low density. Although it is possible to increase the density of TiN precipitates by increasing the heating time, this would increase the manufacturing costs. On the other hand, when the heating temperature is more than 1,250° C., growth of austenite grains occurs in the slab during the heating process, adversely affecting the recrystallization to be performed in the subsequent rolling process. Where the slab heating time is less than 60 minutes, it is impossible to obtain a desired nitrogenizing effect. On the other hand, where the slab heating time is more than 180 minutes, the manufacturing costs increase. Furthermore, growth of austenite grains occurs in the slab, adversely affecting the subsequent rolling process.

More preferably, the heating time at a slab heating temperature of 1,000 to 1,100° C. is 120 to 180 minutes.

Preferably, the nitrogenizing treatment is performed to control, in the slab, the ratio of Ti/N to be 1.2 to 2.5, the ratio of Zr/N to be 0.3 to 2.0, the ratio of N/B to be 10 to 40, the ratio of Al/N to be 2.5 to 7, the ratio of (Ti+Zr+2Al+4B)/N to be 6.8 to 17, the ratio of V/N to be 0.3 to 9, and the ratio of (Ti+2Al+4B+V)/N to be 7 to 17.

Thereafter, the heated steel slab is hot-rolled in an austenite recrystallization temperature range at a thickness reduction rate of 40% or more. The austenite recrystallization temperature range depends on the composition of the steel, and a previous thickness reduction rate. In accordance with the present invention, the austenite recrystallization temperature range is determined to be about 850 to 1,050° C., taking into consideration a typical thickness reduction rate.

Where the hot rolling temperature is less than 850° C., the structure is changed into elongated austenite in the rolling process because the hot rolling temperature is within a non-crystallization temperature range. For this reason, it is difficult to secure fine ferrite in a subsequent cooling process. On the other hand, where the hot rolling temperature is more than 1,050° C., grains of recrystallized austenite formed in accordance with recrystallization are grown, so that they are coarsened. As a result, it is difficult to secure fine ferrite grains in the cooling process. Also, when the accumulated or single thickness reduction rate in the rolling process is less than 40%, there are insufficient sites for formation of ferrite nuclei within austenite grains. As a result, it is impossible to obtain an effect of sufficiently fining ferrite grains in accordance with recrystallization of austenite. Furthermore, there is an adverse effect on the behavior of precipitates advantageously influencing the toughness of the heat affected zone in a welding process.

In accordance with the present invention, the rolled steel slab is then cooled to a temperature ranging ±10° C. from a ferrite transformation finish temperature at a rate of 1° C./min. Preferably, the rolled steel slab is cooled to the ferrite transformation finish temperature at a rate of 1° C./min, and then cooled in air.

Of course, there is no problem associated with fining of ferrite even when the rolled steel slab is cooled to normal temperature at a rate of 1° C./min. However, this is undesirable because it is uneconomical. Although the rolled steel slab is cooled to a temperature ranging ±10° C. from the ferrite transformation finish temperature at a rate of 1° C./min, it is possible to prevent growth of ferrite grains. When the cooling rate is less than 1° C./min, growth of recrystallized fine ferrite grains occurs. In this case, it is difficult to secure a ferrite grain size of 20 μm or less.

As is apparent from the above description, it is possible to obtain a steel product having a complex structure of ferrite and pearlite with a grain size of 20 μm or less as its microstructure while exhibiting a superior heat affected zone toughness by controlling manufacturing conditions such as heating and rolling conditions while regulating the steel composition, for example, the ratio of Ti/N. Also, it is possible to effectively manufacture a weldable structural steel product in which fine TiN precipitates having a grain size of 0.01 to 0.1 μm are precipitated at a density of $1.0\times10^7/mm^2$ or more while having a spacing of 0.5 μm or less.

Meanwhile, slabs can be manufactured using a continuous casting process or a mold casting process as a steel casting process. Where a high cooling rate is used, it is easy to finely disperse precipitates. Accordingly, it is desirable to use a continuous casting process. For the same reason, it is advantageous for the slab to have a small thickness. As the hot rolling process for such a slab, a hot charge rolling process or a direct rolling process may be used. Also, various techniques such as known control rolling processes and controlled cooling processes may be employed. In order to improve the mechanical properties of hot-rolled plates manufactured in accordance with the present invention, a heat treatment may be applied. It should be noted that although such known techniques are applied to the present invention, such an application is made within the scope of the present invention.

Welded Structures

The present invention also relates to a welded structure manufactured using the above described weldable structural steel product. Therefore, included in the present invention are welded structures manufactured using a weldable structural steel product having the above defined composition according to the present invention, a microstructure corresponding to a complex structure of ferrite and pearlite having a grain size of about 20 μm or less, or TiN precipitates having a grain size of 0.01 to 0.1 μm while being dispersed at a density of $1.0\times10^7/mm^2$ or more and with a spacing of 0.5 μm or less.

Where a high heat input welding process is applied to the above described weldable structural steel product, prior austenite having a grain size of 80 μm or less is formed. Where the grain size of the prior austenite is more than 80 μm, an increase in hardenability occurs, thereby causing easy formation of a low-temperature structure (martensite or upper bainite). Furthermore, although ferrites having different nucleus forming sites are formed at grain boundaries of austenite, they are merged together when growth of grains occurs, thereby causing an adverse effect on toughness.

When the steel product is quenched in accordance with an application of a high heat input welding process thereto, the microstructure of the heat affected zone includes ferrite having a grain size of 20 μm or less at a volume fraction of 70% or more. Where the grain size of the ferrite is more than 20 μm, the fraction of side plate or allotriomorphs ferrite adversely affecting the toughness of the heat affected zone increases. In order to achieve an improvement in toughness, it is desirable to control the volume fraction of ferrite to be 70% or more. When the ferrite of the present invention has characteristics of polygonal ferrite or acicular ferrite, an improvement in toughness is expected. In accordance with the present invention, BN and AlN precipitates conduct important functions at grain boundaries and within grains for improving toughness.

When a high heat input welding process is applied to the weldable structural steel product (matrix), prior austenite having a grain size of 80 μm or less is formed at the heat affected zone. In accordance with a subsequent quenching process, the microstructure of the heat affected zone includes ferrite having a grain size of 20 μm or less at a volume fraction of 70% or more.

Where a welding process using a heat input of 100 kJ/cm or less is applied to the weldable structural steel product of the present invention (in the case "$\Delta t_{800\text{-}500}$=60 seconds" in Table 5), the toughness difference between the matrix and the heat affected zone is within a range of ±30 J. In the case of a welding process using a high heat input of 100 to 250 kJ/cm or more ("$\Delta t_{800\text{-}500}$=120 seconds" in Table 5), the toughness difference between the matrix and the heat affected zone is within a range of 0 to 40 J. Also, In the case of a welding process using a high heat input of 250 kJ/cm or more ("$\Delta t_{800\text{-}500}$=180 seconds" in Table 5), the toughness difference between the matrix and the heat affected zone is within a range of 0 to 105 J. Such results can be seen from the following examples.

EXAMPLES

Hereinafter, the present invention will be described in conjunction with various examples. These examples are made only for illustrative purposes, and the present invention is not to be construed as being limited to those examples.

Example 1

Each of steel products having different steel compositions of Table 1 was melted in a converter. The resultant molten steel was treated under the condition of Table 2 to manufacture a slab. The slab was then hot rolled under the condition of Table 4, thereby manufacturing a hot-rolled plate. Table 3 describes content ratios of alloying elements in each steel product.

TABLE 1

| | Chemical Composition (wt %) | | | | | | | | | | | | | | | | | | | |
|---|---|---|---|---|---|---|---|---|---|---|---|---|---|---|---|---|---|---|---|---|
| | C | Si | Mn | P | S | Al | Ti | B (ppm) | N (ppm) | W | Zr | Cu | Ni | Cr | Mo | Nb | V | Ca | REM | O (ppm) |
| PS 1 | 0.12 | 0.13 | 1.54 | 0.006 | 0.005 | 0.04 | 0.014 | 7 | 120 | 0.005 | 0.01 | 0.1 | — | — | — | — | 0.01 | — | — | 11 |
| PS 2 | 0.07 | 0.12 | 1.71 | 0.006 | 0.006 | 0.07 | 0.05 | 10 | 280 | 0.002 | 0.02 | — | 0.2 | — | — | — | 0.01 | — | — | 12 |
| PS 3 | 0.14 | 0.10 | 1.9 | 0.006 | 0.008 | 0.06 | 0.015 | 3 | 110 | 0.003 | 0.01 | — | — | — | — | — | 0.02 | — | — | 10 |
| PS 4 | 0.10 | 0.12 | 1.80 | 0.006 | 0.007 | 0.02 | 0.02 | 5 | 80 | 0.001 | 0.01 | 0.1 | — | — | — | — | 0.05 | — | — | 9 |
| PS 5 | 0.08 | 0.15 | 2.0 | 0.006 | 0.006 | 0.09 | 0.05 | 15 | 300 | 0.002 | 0.02 | — | — | 0.1 | — | — | 0.05 | — | — | 12 |
| PS 6 | 0.10 | 0.14 | 2.0 | 0.007 | 0.005 | 0.025 | 0.02 | 10 | 100 | 0.004 | 0.01 | — | — | — | 0.1 | — | 0.09 | — | — | 9 |
| PS 7 | 0.13 | 0.14 | 1.6 | 0.007 | 0.007 | 0.04 | 0.015 | 8 | 115 | 0.15 | 0.01 | 0.1 | — | — | — | — | 0.02 | — | — | 11 |
| PS 8 | 0.11 | 0.15 | 1.52 | 0.007 | 0.006 | 0.06 | 0.018 | 10 | 120 | 0.001 | 0.005 | — | — | — | — | 0.015 | 0.01 | — | — | 10 |
| PS 9 | 0.13 | 0.21 | 1.42 | 0.007 | 0.005 | 0.025 | 0.02 | 4 | 90 | 0.002 | 0.01 | — | — | 0.1 | — | — | 0.02 | 0.001 | — | 12 |
| PS 10 | 0.07 | 0.16 | 2.0 | 0.008 | 0.010 | 0.045 | 0.025 | 6 | 100 | 0.05 | 0.005 | — | 0.3 | — | — | 0.01 | 0.02 | — | 0.01 | 11 |
| PS 11 | 0.11 | 0.21 | 1.48 | 0.007 | 0.006 | 0.047 | 0.019 | 11 | 130 | 0.01 | 0.005 | — | 0.1 | — | — | — | — | — | — | 15 |
| CS 1 | 0.05 | 0.13 | 1.31 | 0.002 | 0.006 | 0.0014 | 0.009 | 1.6 | 22 | — | — | — | — | — | — | — | — | — | — | 22 |
| CS 2 | 0.05 | 0.11 | 1.34 | 0.002 | 0.003 | 0.0036 | 0.012 | 0.5 | 48 | — | — | — | — | — | — | — | — | — | — | 32 |
| CS 3 | 0.13 | 0.24 | 1.44 | 0.012 | 0.003 | 0.0044 | 0.010 | 1.2 | 127 | — | — | 0.3 | — | — | — | 0.05 | — | — | — | 138 |
| CS 4 | 0.06 | 0.18 | 1.35 | 0.008 | 0.002 | 0.0027 | 0.013 | 8 | 32 | — | — | — | — | 0.14 | 0.15 | — | 0.028 | — | — | 25 |
| CS 5 | 0.06 | 0.18 | 0.88 | 0.006 | 0.002 | 0.0021 | 0.013 | 5 | 20 | — | — | 0.75 | 0.58 | 0.24 | 0.14 | 0.015 | 0.037 | — | — | 27 |
| CS 6 | 0.13 | 0.27 | 0.98 | 0.005 | 0.001 | 0.001 | 0.009 | 11 | 28 | — | | 0.35 | 1.15 | 0.53 | 0.49 | 0.001 | 0.045 | — | — | 25 |
| CS 7 | 0.13 | 0.24 | 1.44 | 0.004 | 0.002 | 0.02 | 0.008 | 8 | 79 | — | — | 0.3 | — | — | — | 0.036 | — | — | | — |
| CS 8 | 0.07 | 0.14 | 1.52 | 0.004 | 0.002 | 0.002 | 0.007 | 4 | 57 | — | — | 0.32 | 0.35 | — | — | 0.013 | — | — | — | — |
| CS 9 | 0.06 | 0.25 | 1.31 | 0.008 | 0.002 | 0.019 | 0.007 | 10 | 91 | — | — | — | — | 0.21 | 0.19 | 0.025 | 0.035 | — | — | — |
| CS 10 | 0.09 | 0.26 | 0.86 | 0.009 | 0.003 | 0.046 | 0.008 | 15 | 142 | — | — | — | 1.09 | 0.51 | 0.36 | 0.021 | 0.021 | — | — | — |
| CS 11 | 0.14 | 0.44 | 1.35 | 0.012 | 0.012 | 0.030 | 0.049 | 7 | 89 | — | — | — | — | — | — | — | 0.069 | — | — | — |

The CS s 1, 2 and 3 are the inventive steels 5, 32, and 55 of Japanese Patent Laid-open Publication No. Hei. 9-194990.
The CS s 4, 5, and 6 are the inventive steels 14, 24, and 28 of Japanese Patent Laid-open Publication No. Hei. 10-298708.
The CS s 7, 8, 9, and 10 are the inventive steels 48, 58, 60, 61 of Japanese Patent Laid-open Publication No. Hei. 8-60292.
The CS 11 is the inventive steel F of Japanese Patent Laid-open Publication No. Hei. 11-140582.
PS: Present Steel
CS: Conventional Steel

TABLE 2

| Steel Products | Sample | Primary Deoxidation Order | Dissolved Oxygen Amount after Addition of Al (ppm) | Amount of Ti Added after Deoxidation (%) | Casting Speed (m/min) | Water Spray Amount (l/kg) |
|---|---|---|---|---|---|---|
| Present Steel 1 | Present Sample 1 | Mn→Si | 19 | 0.014 | 1.1 | 0.32 |
| | Present Sample 2 | Mn→Si | 18 | 0.014 | 1.1 | 0.32 |
| | Present Sample 3 | Mn→Si | 18 | 0.014 | 1.1 | 0.32 |
| | Comparative Sample 1 | Mn→Si | 32 | 0.014 | 1.1 | 0.32 |
| | Comparative Sample 2 | Mn→Si | 58 | 0.014 | 1.1 | 0.32 |
| Present Steel 2 | Present Sample 4 | Mn→Si | 16 | 0.05 | 1.0 | 0.35 |

TABLE 2-continued

| Steel Products | Sample | Primary Deoxidation Order | Dissolved Oxygen Amount after Addition of Al (ppm) | Amount of Ti Added after Deoxidation (%) | Casting Speed (m/min) | Water Spray Amount (l/kg) |
|---|---|---|---|---|---|---|
| Present Steel 3 | Present Sample 5 | Mn→Si | 15 | 0.015 | 1.0 | 0.35 |
| Present Steel 4 | Present Sample 6 | Mn→Si | 15 | 0.02 | 1.0 | 0.35 |
| Present Steel 5 | Present Sample 7 | Mn→Si | 12 | 0.05 | 1.2 | 0.30 |
| Present Steel 6 | Present Sample 8 | Mn→Si | 17 | 0.02 | 1.2 | 0.30 |
| Present Steel 7 | Present Sample 9 | Mn→Si | 18 | 0.015 | 1.1 | 0.32 |
| Present Steel 8 | Present Sample 10 | Mn→Si | 14 | 0.018 | 1.1 | 0.32 |
| Present Steel 9 | Present Sample 11 | Mn→Si | 19 | 0.02 | 1.1 | 0.32 |
| Present Steel 10 | Present Sample 12 | Mn→Si | 22 | 0.025 | 1.0 | 0.35 |
| Present Steel 11 | Present Sample 13 | Mn→Si | 20 | 0.019 | 1.0 | 0.35 |

There is no detailed manufacturing condition for the conventional steels 1 to 11.

TABLE 3

| | Content Ratios of Alloying Elements | | | | | |
|---|---|---|---|---|---|---|
| | Ti/N | Zr/N | N/B | Al/N | V/N | (Ti + Zr + 2Al + 4B + V)/N |
| Present Sample 1 | 1.2 | 0.8 | 17.1 | 3.3 | 0.8 | 9.7 |
| Present Sample 2 | 1.2 | 0.8 | 17.1 | 3.3 | 0.8 | 9.7 |
| Present Sample 3 | 1.2 | 0.8 | 17.1 | 3.3 | 0.8 | 9.7 |
| Present Sample 4 | 1.8 | 0.7 | 28.0 | 2.5 | 0.4 | 8.0 |
| Present Sample 5 | 1.4 | 0.9 | 36.7 | 5.5 | 1.8 | 15.1 |
| Present Sample 6 | 2.5 | 1.3 | 16.0 | 2.5 | 6.3 | 15.3 |
| Present Sample 7 | 1.7 | 0.7 | 20.0 | 3.0 | 1.7 | 10.2 |
| Present Sample 8 | 2.0 | 1.0 | 10.0 | 2.5 | 9.0 | 17.4 |
| Present Sample 9 | 1.3 | 0.9 | 14.4 | 3.5 | 1.7 | 11.1 |
| Present Sample 10 | 1.5 | 0.4 | 12.0 | 5.0 | 0.8 | 13.1 |
| Present Sample 11 | 2.2 | 1.1 | 22.5 | 2.8 | 2.2 | 11.3 |
| Present Sample 12 | 2.5 | 0.5 | 16.7 | 4.5 | 2.0 | 14.2 |
| Present Sample 13 | 1.5 | 0.4 | 11.8 | 3.6 | — | 9.4 |
| Conventional Steel 1 | 4.1 | — | 13.8 | 0.6 | — | 5.7 |

TABLE 3-continued

| | Content Ratios of Alloying Elements | | | | | |
|---|---|---|---|---|---|---|
| | Ti/N | Zr/N | N/B | Al/N | V/N | (Ti + Zr + 2Al + 4B + V)/N |
| Conventional Steel 2 | 2.5 | — | 96.0 | 0.8 | — | 4.0 |
| Conventional Steel 3 | 0.8 | — | 105.8 | 0.4 | — | 1.5 |
| Conventional Steel 4 | 4.1 | — | 4.0 | 0.8 | 8.8 | 15.5 |
| Conventional Steel 5 | 6.5 | — | 4.0 | 1.1 | 18.5 | 28.1 |
| Conventional Steel 6 | 3.2 | — | 2.6 | 0.4 | 16.1 | 21.6 |
| Conventional Steel 7 | 1.0 | — | 9.9 | 2.5 | — | 6.5 |
| Conventional Steel 8 | 1.2 | — | 14.3 | 0.4 | — | 2.2 |
| Conventional Steel 9 | 0.8 | — | 9.1 | 2.1 | 3.9 | 9.2 |
| Conventional Steel 10 | 0.6 | — | 9.5 | 3.2 | 1.5 | 8.9 |
| Conventional Steel 11 | 5.5 | — | 12.7 | 3.4 | 7.8 | 20.3 |

TABLE 4

| Steel Products | Samples | Heating Temp. (° C.) | Heating Time (min) | Rolling Start Temp. (° C.) | Rolling End Time(° C.) | TRR(%)/ ATRR (%)*1) | Cooling Rate (° C./min) | Cooling End Time(° C.) |
|---|---|---|---|---|---|---|---|---|
| Present Sample 2 | PE 1 | 1150 | 170 | 1030 | 780 | 65/80 | 7 | 600 |
| | PE 2 | 1200 | 130 | 1040 | 790 | 65/80 | 7 | 600 |
| | PE 3 | 1240 | 90 | 1040 | 780 | 65/80 | 7 | 600 |

TABLE 4-continued

| Steel Products | Samples | Heating Temp. (° C.) | Heating Time (min) | Rolling Start Temp. (° C.) | Rolling End Time(° C.) | TRR(%)/ ATRR (%)*1) | Cooling Rate (° C./min) | Cooling End Time(° C.) |
|---|---|---|---|---|---|---|---|---|
| | CE 1 | 1050 | 60 | 1040 | 780 | 65/80 | 7 | 600 |
| | CE 2 | 1300 | 250 | 1035 | 780 | 65/80 | 7 | 600 |
| Present Sample 1 | PE 4 | 1200 | 130 | 1020 | 790 | 65/80 | 6 | 600 |
| Present Sample 3 | PE 5 | 1200 | 130 | 1040 | 790 | 65/80 | 6 | 600 |
| Comparative Sample 1 | CE 3 | 1210 | 120 | 1030 | 780 | 65/80 | 0.1 | room temperature |
| Comparative Sample 2 | CE 4 | 1210 | 120 | 1030 | 790 | 65/80 | 19 | room temperature |
| Present Sample 4 | PE 6 | 1180 | 150 | 1020 | 790 | 60/80 | 7 | 600 |
| Present Sample 5 | PE 7 | 1190 | 140 | 1010 | 800 | 60/80 | 8 | 600 |
| Present Sample 6 | PE 8 | 1220 | 110 | 1010 | 810 | 60/75 | 7 | 600 |
| Present Sample 7 | PE 9 | 1220 | 110 | 1020 | 800 | 60/75 | 10 | 600 |
| Present Sample 8 | PE 10 | 1210 | 120 | 1010 | 790 | 60/75 | 10 | 600 |
| Present Sample 9 | PE 11 | 1220 | 110 | 1000 | 780 | 55/70 | 10 | 600 |
| Present Sample 10 | PE 12 | 1210 | 120 | 1010 | 790 | 55/70 | 9 | 600 |
| Present Sample 11 | PE 13 | 1230 | 100 | 1000 | 800 | 55/70 | 8 | 600 |
| Present Sample 12 | PE 14 | 1220 | 110 | 1020 | 780 | 55/70 | 10 | 600 |
| Present Sample 13 | PE 15 | 1210 | 130 | 1020 | 780 | 65/75 | 10 | 600 |
| Conventional Steel 11 | | 1200 | — | $Ar_3$ or more | 960 | 80 | Naturally Cooled | |

There is no detailed manufacturing condition for the conventional steels 1 to 10.
TRR/ATRR*1): Thickness Reduction Rate/Accumulated Thickness Reduction Rate in Recrystallization Range
PE: Present Example
CE: Comparative Example Test pieces were sampled from the hot-rolled products. The sampling was performed at the central portion of each hot-rolled product in a thickness direction. In particular, test pieces for a tensile test were sampled in a rolling direction, whereas test pieces for a Charpy impact test were sampled in a direction perpendicular to the rolling direction.

Using steel test pieces sampled as described above, characteristics of precipitates in each steel product (matrix), and mechanical properties of the steel product were measured. The measured results are described in Table 5. Also, the microstructure and impact toughness of the heat affected zone were measured. The measured results are described in Table 6.

These measurements were carried out as follows.

For tensile test pieces, test pieces of KS Standard No. 4 (KS B 0801) were used. The tensile test was carried out at a cross heat speed of 5 mm/min. On the other hand, impact test pieces were prepared, based on the test piece of KS Standard No. 3 (KS B 0809). For the impact test pieces, notches were machined at a side surface (L-T) in a rolling direction in the case of the matrix while being machined in a welding line direction in the case of the welding material. In order to inspect the size of austenite grains at a maximum heating temperature of the heat affected zone, each test piece was heated to a maximum heating temperature of 1,200 to 1,400° C. at a heating rate of 140° C./sec using a reproducible welding simulator, and then quenched using He gas after being maintained for one second. After the quenched test piece was polished and eroded, the grain size of austenite in the resultant test piece at a maximum heating temperature condition was measured in accordance with a KS Standard (KS D 0205).

The microstructure obtained after the cooling process, and the grain sizes, densities, and spacing of precipitates and oxides seriously influencing the toughness of the heat affected zone were measured in accordance with a point counting scheme using an image analyzer and an electronic microscope. The measurement was carried out for a test area of 100 $mm^2$. The impact toughness of the heat affected zone in each test piece was evaluated by subjecting the test piece to welding conditions corresponding to welding heat inputs of about 80 kJ/cm, 150 kJ/cm, and 250 kJ/cm, that is, welding cycles involving heating at a maximum heating temperature of 1,400° C., to a temperature range of 800–500t and cooling for 60 seconds, 120 seconds, and 180 seconds, respectively, polishing the surface of the test piece, machining the test piece for an impact test, and then conducting a Charpy impact test for the test piece at a temperature of −40° C.

TABLE 5

| Samples | Characteristics of Precipitates of TiN: Density (number/mm$^2$) | Mean Size (μm) | Spacing (μm) | Characteristics of Matrix Structure and Mechanical Properties of Matrix: Thickness (mm) | Yield Strength (MPa) | Tensile Strength (MPa) | Elongation (%) | FGS (μm) | Volume Fraction of Ferrite (%) | −40° C. Impact Toughness (J) |
|---|---|---|---|---|---|---|---|---|---|---|
| PE 1 | $2.4 \times 10^8$ | 0.016 | 0.25 | 25 | 394 | 553 | 38 | 11 | 74 | 358 |
| PE 2 | $3.2 \times 10^8$ | 0.017 | 0.24 | 25 | 395 | 551 | 39 | 9 | 73 | 362 |
| PE 3 | $2.5 \times 10^8$ | 0.012 | 0.26 | 25 | 396 | 550 | 39 | 10 | 75 | 357 |
| CE 1 | $2.3 \times 10^6$ | 0.174 | 1.6 | 25 | 393 | 554 | 26 | 16 | 54 | 206 |
| CE 2 | $3.4 \times 10^6$ | 0.165 | 1.8 | 25 | 792 | 860 | 17 | 17 | 21 | 45 |
| PE 4 | $3.2 \times 10^8$ | 0.025 | 0.32 | 30 | 396 | 558 | 38 | 11 | 73 | 349 |
| PE 5 | $2.6 \times 10^8$ | 0.013 | 0.34 | 30 | 396 | 562 | 38 | 10 | 73 | 354 |
| CE 3 | $1.3 \times 10^6$ | 0.182 | 1.2 | 30 | 384 | 564 | 30 | 18 | 63 | 220 |
| CE 4 | $4.3 \times 10^6$ | 0.177 | 1.4 | 30 | 392 | 582 | 29 | 17 | 54 | 208 |
| PE 6 | $3.3 \times 10^8$ | 0.026 | 0.35 | 30 | 390 | 563 | 38 | 10 | 72 | 364 |
| PE 7 | $4.6 \times 10^8$ | 0.024 | 0.32 | 35 | 390 | 564 | 39 | 10 | 75 | 360 |
| PE 8 | $4.3 \times 10^8$ | 0.014 | 0.40 | 35 | 392 | 542 | 36 | 11 | 78 | 365 |
| PE 9 | $5.6 \times 10^8$ | 0.028 | 0.29 | 35 | 391 | 536 | 37 | 10 | 79 | 359 |
| PE 10 | $5.2 \times 10^8$ | 0.021 | 0.28 | 35 | 394 | 566 | 36 | 10 | 78 | 375 |
| PE 11 | $3.7 \times 10^8$ | 0.029 | 0.25 | 40 | 390 | 566 | 37 | 12 | 76 | 364 |
| PE 12 | $3.2 \times 10^8$ | 0.025 | 0.31 | 40 | 396 | 542 | 38 | 11 | 80 | 356 |
| PE 13 | $3.3 \times 10^8$ | 0.042 | 0.34 | 40 | 406 | 564 | 38 | 12 | 80 | 348 |
| PE 14 | $3.6 \times 10^8$ | 0.032 | 0.28 | 40 | 387 | 550 | 37 | 10 | 81 | 349 |
| PE 15 | $4.2 \times 10^8$ | 0.018 | 0.26 | 30 | 389 | 549 | 39 | 9 | 78 | 368 |
| CS 1 | | | | 35 | 406 | 436 | | | | |
| CS 2 | | | | 35 | 405 | 441 | | | | |
| CS 3 | | | | 25 | 629 | 681 | | | | |
| CS 4 | Precipitates of MgO-TiN $3.03 \times 10^6$/mm$^2$ | | | 40 | 472 | 609 | | | | |
| CS 5 | Precipitates of MgO-TiN $4.07 \times 10^6$/mm$^2$ | | | 40 | 494 | 622 | | | | |
| CS 6 | Precipitates of MgO-TiN $2.80 \times 10^6$/mm$^2$ | | | 50 | 812 | 912 | | | | |
| CS 7 | | | | 25 | 629 | 681 | | | | |
| CS 8 | | | | 50 | 504 | 601 | | | | |
| CS 9 | | | | 60 | 526 | 648 | | | | |
| CS 10 | | | | 60 | 760 | 829 | | | | |
| CS 11 | | | | 50 | 401 | 514 | | | | |

PE: Present Example
CE: Comparative Example
CS: Conventional Steel

Referring to Table 5, it can be seen that the density of precipitates (TiN precipitates) in each hot-rolled product manufactured in accordance with the present invention is $1.0 \times 10^8$/mm$^2$ or more, whereas the density of precipitates in each conventional product is $4.07 \times 10^5$/mm$^2$ or less.

It was found that ZrN precipitates having a grain size of 50 to 100 nm exist in the products of the present invention. Also, the products of the present invention had a matrix structure in which fine ferrite having a grain size of about 12 μm or less has a high fraction of 70% or more.

TABLE 6

| Samples | Grain Size of Austenite in Heat Affected Zone (μm): 1,200 (° C.) | 1,300 (° C.) | 1400 (° C.) | Microstructure of Heat Affected Zone with Heat Input of 100 kJ/cm: Volume Fraction of Ferrite (%) | Mean Grain Size of Ferrite (μm) | Reproducible Heat Affected Zone Impact Toughness (J) at −40° C. (Maximum Heating Temp. 1,400° C.): $\Delta t_{800-500}$ = 60 sec: Yield Strength (kg/mm$^2$) | Tensile Strength (kg/mm$^2$) | $\Delta t_{800-500}$ = 120 sec: Impact Toughness (J) | Transition Temp. (° C.) | $\Delta t_{800-500}$ = 180 sec: Impact Toughness (J) | Transition Temp. (° C.) |
|---|---|---|---|---|---|---|---|---|---|---|---|
| PE 1 | 23 | 34 | 56 | 74 | 15 | 372 | −74 | 332 | −67 | 293 | −63 |
| PE 2 | 22 | 35 | 55 | 77 | 13 | 384 | −76 | 350 | −69 | 302 | −64 |
| PE 3 | 23 | 35 | 56 | 75 | 13 | 366 | −72 | 330 | −67 | 295 | −63 |
| CE 1 | 54 | 86 | 182 | 38 | 24 | 124 | −43 | 43 | −34 | 28 | −28 |

TABLE 6-continued

| | Grain Size of Austenite in Heat Affected Zone (μm) | | | Microstructure of Heat Affected Zone with Heat Input of 100 kJ/cm | | Reproducible Heat Affected Zone Impact Toughness (J) at −40° C. (Maximum Heating Temp. 1,400° C.) | | | | | |
|---|---|---|---|---|---|---|---|---|---|---|---|
| | | | | Volume Fraction | Mean Grain | $\Delta t_{800-500}$ = 60 sec | | $\Delta t_{800-500}$ = 120 sec | | $\Delta t_{800-500}$ = 180 sec | |
| Samples | 1,200 (° C.) | 1,300 (° C.) | 1400 (° C.) | of Ferrite (%) | Size of Ferrite (μm) | Yield Strength (kg/mm²) | Tensile Strength (kg/mm²) | Impact Toughness (J) | Transition Temp. (° C.) | Impact Toughness (J) | Transition Temp. (° C.) |
| CE 2 | 65 | 92 | 198 | 36 | 26 | 102 | −40 | 30 | −32 | 17 | −25 |
| PE 4 | 25 | 38 | 63 | 76 | 14 | 353 | −71 | 328 | −68 | 284 | −65 |
| PB 5 | 26 | 41 | 57 | 78 | 15 | 365 | −71 | 334 | −67 | 295 | −62 |
| CE 3 | 56 | 80 | 178 | 40 | 26 | 108 | −39 | 56 | −32 | 24 | −24 |
| CE 4 | 63 | 88 | 184 | 39 | 28 | 64 | −28 | 39 | −30 | 10 | −21 |
| PE 6 | 25 | 32 | 53 | 75 | 14 | 383 | −73 | 354 | −69 | 303 | −63 |
| PE 7 | 24 | 35 | 55 | 77 | 14 | 365 | −71 | 337 | −67 | 292 | −63 |
| PE 8 | 27 | 37 | 53 | 74 | 13 | 362 | −71 | 339 | −67 | 296 | −62 |
| PE 9 | 24 | 36 | 52 | 78 | 15 | 368 | −72 | 330 | −67 | 284 | −63 |
| PE 10 | 22 | 34 | 53 | 75 | 14 | 383 | −72 | 345 | −66 | 293 | −63 |
| PE 11 | 26 | 35 | 64 | 75 | 14 | 356 | −71 | 328 | −68 | 282 | −68 |
| PE 12 | 27 | 39 | 64 | 74 | 15 | 353 | −71 | 321 | −67 | 276 | −62 |
| PE 13 | 23 | 38 | 68 | 74 | 14 | 354 | −71 | 320 | −67 | 254 | −62 |
| PE 14 | 25 | 35 | 64 | 70 | 15 | 342 | −71 | 326 | −67 | 248 | −63 |
| PB 15 | 23 | 36 | 53 | 76 | 16 | 349 | −72 | 332 | −68 | 293 | −94 |
| CS 1 | | | | | | | −58 | | | | |
| CS 2 | | | | | | | −55 | | | | |
| CS 3 | | | | | | | −54 | | | | |
| CS 4 | | 230 | | 93 | | | | | | 132 (0° C.) | |
| CS 5 | | 180 | | 87 | | | | | | 129 (0° C.) | |
| CS 6 | | 250 | | 47 | | | | | | 60 (0° C.) | |
| CS 7 | | | | | | | −60 | | | | −61 |
| CS 8 | | | | | | | −59 | | | | −48 |
| CS 9 | | | | | | | −54 | | | | −42 |
| CS 10 | | | | | | | −57 | | | | −45 |
| CS 11 | | | | | | | | 219 (0° C.) | | | |

PE: Present Example
CE: Comparative Example
CS: Conventional Steel

Referring to Table 6, it can be seen that the size of austenite grains under a maximum heating temperature condition of 1,400° C., as in the heat affected zone, is within a range of 52 to 64 μm in the case of the present invention, whereas the austenite grains in the conventional products are very coarse to have a grain size of about 180 μm. Thus, the steel products of the present invention have a superior effect of suppressing the growth of austenite grains at the heat affected zone in a welding process. Where a welding process using a heat input of 100 kJ/cm is applied, the steel products of the present invention have a ferrite fraction of about 70% or more.

Example 2

Control of Deoxidation:Nitrogenizing Treatment

Samples were prepared using steel products having respective compositions of Table 7. Each sample was melted in a converter. The resultant molten steel was cast after being subjected to a refining treatment under the condition of Table 8, thereby forming a steel slab. The slab was then hot rolled under the condition of Table 9, thereby manufacturing a hot-rolled plate. Table 9 describes content ratios of alloying elements in each steel product subjected to a nitrogenizing treatment.

TABLE 7

| | Chemical Composition (wt %) | | | | | | | | | | | | | | | | | | | |
|---|---|---|---|---|---|---|---|---|---|---|---|---|---|---|---|---|---|---|---|---|
| | C | Si | Mn | P | S | Al | Ti | B (ppm) | N (ppm) | W | Zr | Cu | Ni | Cr | Mo | Nb | V | Ca | REM | O (ppm) |
| PS 1 | 0.12 | 0.13 | 1.54 | 0.006 | 0.005 | 0.04 | 0.014 | 7 | 40 | 0.005 | 0.01 | 0.1 | — | — | — | — | 0.01 | — | — | 11 |
| PS 2 | 0.07 | 0.12 | 1.71 | 0.006 | 0.006 | 0.07 | 0.05 | 10 | 48 | 0.002 | 0.02 | — | 0.2 | — | — | — | 0.01 | — | — | 12 |

TABLE 7-continued

| | Chemical Composition (wt %) | | | | | | | | | | | | | | | | | | | |
|---|---|---|---|---|---|---|---|---|---|---|---|---|---|---|---|---|---|---|---|---|
| | C | Si | Mn | P | S | Al | Ti | B (ppm) | N (ppm) | W | Zr | Cu | Ni | Cr | Mo | Nb | V | Ca | REM | O (ppm) |
| PS 3 | 0.14 | 0.10 | 1.9 | 0.006 | 0.008 | 0.06 | 0.015 | 3 | 42 | 0.003 | 0.01 | — | — | — | — | — | 0.02 | — | — | 10 |
| PS 4 | 0.10 | 0.12 | 1.80 | 0.006 | 0.007 | 0.02 | 0.02 | 5 | 40 | 0.001 | 0.01 | 0.1 | — | — | — | — | 0.05 | — | — | 9 |
| PS 5 | 0.08 | 0.15 | 2.0 | 0.006 | 0.006 | 0.09 | 0.05 | 15 | 45 | 0.002 | 0.02 | — | — | 0.1 | — | — | 0.05 | — | — | 12 |
| PS 6 | 0.10 | 0.14 | 2.0 | 0.007 | 0.005 | 0.025 | 0.02 | 10 | 47 | 0.004 | 0.01 | — | — | — | 0.1 | — | 0.09 | — | — | 9 |
| PS 7 | 0.13 | 0.14 | 1.6 | 0.007 | 0.007 | 0.04 | 0.015 | 8 | 45 | 0.15 | 0.01 | 0.1 | — | — | — | — | 0.02 | — | — | 11 |
| PS 8 | 0.11 | 0.15 | 1.52 | 0.007 | 0.006 | 0.06 | 0.018 | 10 | 42 | 0.001 | 0.005 | — | — | — | — | 0.015 | 0.01 | — | — | 10 |
| PS 9 | 0.13 | 0.21 | 1.42 | 0.007 | 0.005 | 0.025 | 0.02 | 4 | 36 | 0.002 | 0.01 | — | — | 0.1 | — | — | 0.02 | 0.001 | — | 12 |
| PS 10 | 0.07 | 0.16 | 2.0 | 0.008 | 0.010 | 0.045 | 0.025 | 6 | 45 | 0.05 | 0.005 | — | 0.3 | — | — | 0.01 | 0.02 | — | 0.01 | 11 |
| PS 11 | 0.09 | 0.21 | 1.48 | 0.007 | 0.006 | 0.047 | 0.019 | 11 | 48 | 0.01 | 0.005 | — | 0.1 | — | — | — | — | — | — | 15 |
| CS 1 | 0.05 | 0.13 | 1.31 | 0.002 | 0.006 | 0.0014 | 0.009 | 1.6 | 22 | — | | — | — | — | — | — | — | — | — | 22 |
| CS 2 | 0.05 | 0.11 | 1.34 | 0.002 | 0.003 | 0.0036 | 0.012 | 0.5 | 48 | — | | — | — | — | — | — | — | — | — | 32 |
| CS 3 | 0.13 | 0.24 | 1.44 | 0.012 | 0.003 | 0.0044 | 0.010 | 1.2 | 127 | — | | 0.3 | — | — | — | 0.05 | — | — | — | 138 |
| CS 4 | 0.06 | 0.18 | 1.35 | 0.008 | 0.002 | 0.0027 | 0.013 | 8 | 32 | — | | — | — | 0.14 | 0.15 | — | 0.028 | — | — | 27 |
| CS 5 | 0.06 | 0.18 | 0.88 | 0.006 | 0.002 | 0.0021 | 0.013 | 5 | 20 | — | | 0.75 | 0.58 | 0.24 | 0.14 | 0.015 | 0.037 | — | — | 25 |
| CS 6 | 0.13 | 0.27 | 0.98 | 0.005 | 0.001 | 0.001 | 0.009 | 11 | 28 | — | | 0.35 | 1.15 | 0.53 | 0.49 | 0.001 | 0.045 | — | — | — |
| CS 7 | 0.13 | 0.24 | 1.44 | 0.004 | 0.002 | 0.02 | 0.008 | 8 | 79 | — | | 0.3 | — | — | — | 0.036 | — | | — | |
| CS 8 | 0.07 | 0.14 | 1.52 | 0.004 | 0.002 | 0.002 | 0.007 | 4 | 57 | — | | 0.32 | 0.35 | — | — | 0.013 | — | — | — | — |
| CS 9 | 0.06 | 0.25 | 1.31 | 0.008 | 0.002 | 0.019 | 0.007 | 10 | 91 | — | | — | — | 0.21 | 0.19 | 0.025 | 0.035 | — | — | — |
| CS 10 | 0.09 | 0.26 | 0.86 | 0.009 | 0.003 | 0.046 | 0.008 | 15 | 142 | — | | — | 1.09 | 0.51 | 0.36 | 0.021 | 0.021 | — | — | — |
| CS 11 | 0.14 | 0.44 | 1.35 | 0.012 | 0.012 | 0.030 | 0.049 | 7 | 89 | — | | — | — | — | — | — | 0.069 | — | — | — |

The CS s 1, 2 and 3 are the inventive steels 5, 32, and 55 of Japanese Patent Laid-open Publication No. Hei. 9-194990.
The CS s 4, 5, and 6 are the inventive steels 14, 24, and 28 of Japanese Patent Laid-open Publication No. Hei. 10-298708.
The CS s 7, 8, 9, and 10 are the inventive steels 48, 58, 60, 61 of Japanese Patent Laid-open Publication No. Hei. 8-60292.
The CS 11 is the inventive steel F of Japanese Paten Laid-open Publication No. Hei. 11-140582.
PS: Present Steel
CS: Conventional Steel

TABLE 8

| Steel Products | Sample | Primary Deoxidation Order | Dissolved Oxygen Amount after Addition of Al (ppm) | Amount of Ti Added after Deoxidation (%) | Casting Speed (m/min) | Water Spray Amount (l/kg) |
|---|---|---|---|---|---|---|
| Present Steel 1 | Present Sample 1 | Mn→Si | 19 | 0.014 | 1.1 | 0.32 |
| | Present Sample 2 | Mn→Si | 18 | 0.014 | 1.1 | 0.32 |
| | Present Sample 3 | Mn→Si | 18 | 0.014 | 1.1 | 0.32 |
| | Comparative Sample 1 | Mn→Si | 32 | 0.014 | 1.1 | 0.32 |
| | Comparative Sample 2 | Mn→Si | 58 | 0.014 | 1.1 | 0.32 |
| Present Steel 2 | Present Sample 4 | Mn→Si | 16 | 0.05 | 1.0 | 0.35 |
| Present Steel 3 | Present Sample 5 | Mn→Si | 15 | 0.015 | 1.0 | 0.35 |

TABLE 8-continued

| Steel Products | Sample | Primary Deoxidation Order | Dissolved Oxygen Amount after Addition of Al (ppm) | Amount of Ti Added after Deoxidation (%) | Casting Speed (m/min) | Water Spray Amount (l/kg) |
|---|---|---|---|---|---|---|
| Present Steel 4 | Present Sample 6 | Mn→Si | 15 | 0.02 | 1.0 | 0.35 |
| Present Steel 5 | Present Sample 7 | Mn→Si | 12 | 0.05 | 1.2 | 0.30 |
| Present Steel 6 | Present Sample 8 | Mn→Si | 17 | 0.02 | 1.2 | 0.30 |
| Present Steel 7 | Present Sample 9 | Mn→Si | 18 | 0.015 | 1.1 | 0.32 |
| Present Steel 8 | Present Sample 10 | Mn→Si | 14 | 0.018 | 1.1 | 0.32 |
| Present Steel 9 | Present Sample 11 | Mn→Si | 19 | 0.02 | 1.1 | 0.32 |
| Present Steel 10 | Present Sample 12 | Mn→Si | 22 | 0.025 | 1.0 | 0.35 |
| Present Steel 11 | Present Sample 13 | Mn→Si | 20 | 0.019 | 1.0 | 0.35 |

There is no detailed hot rolling condition for the conventional steels 1 to 11.

TABLE 9

| Sample | Heating Temp. (° C.) | Nitrogenizing Atmosphere (l/min) | Heating Time (min) | Rolling Start Temp. (° C.) | Rolling End Temp. (° C.) | TRR(%)/ ATRR (%) in Recrystallization Range | Cooling Rate (° C./min) | Nitrogen Content of Matrix (ppm) |
|---|---|---|---|---|---|---|---|---|
| Present Sample 1 | 1220 | 350 | 160 | 1030 | 830 | 55/75 | 5 | 105 |
| Present Sample 2 | 1190 | 610 | 120 | 1020 | 830 | 55/75 | 5 | 115 |
| Present Sample 3 | 1150 | 780 | 100 | 1020 | 830 | 55/75 | 5 | 120 |
| Comparative Sample 1 | 1050 | 220 | 50 | 1020 | 840 | 55/75 | 5 | 48 |
| Comparative Sample 2 | 1300 | 950 | 180 | 1020 | 840 | 55/75 | 5 | 420 |
| Present Sample 4 | 1180 | 780 | 110 | 1010 | 830 | 55/75 | 6 | 275 |
| Present Sample 5 | 1200 | 600 | 100 | 1040 | 850 | 55/75 | 7 | 112 |
| Present Sample 6 | 1170 | 620 | 130 | 1030 | 840 | 55/75 | 7 | 80 |
| Present Sample 7 | 1190 | 780 | 100 | 1020 | 830 | 55/75 | 6 | 300 |
| Present Sample 8 | 1200 | 620 | 110 | 1030 | 830 | 55/75 | 6 | 100 |
| Present Sample 9 | 1150 | 750 | 160 | 1040 | 830 | 60/70 | 6 | 115 |
| Present Sample 10 | 1180 | 630 | 110 | 1040 | 850 | 60/70 | 5 | 120 |
| Present Sample 11 | 1200 | 520 | 100 | 1050 | 840 | 60/70 | 8 | 90 |
| Present Sample 12 | 1210 | 550 | 120 | 1040 | 840 | 60/70 | 7 | 100 |
| Present Sample 13 | 1230 | 680 | 110 | 1030 | 840 | 60/70 | 8 | 132 |
| Conventional Steel 11 | 1200 | — | — | $Ar_3$ or more | 960 | | Naturally Cooled | — |

The cooling of each present sample is carried out under the condition in which its cooling rate is controlled, until the temperature of the sample reaches 600° C. corresponding to a ferrite transformation finish temperature. Following this temperature, the present sample is cooled in air. The conventional steels 1 to 11 are used to manufacture hot-rolled products without any nitrogenizing treatment. There is no detailed hot rolling condition for the conventional steels 1 to 11.

TRR/ATRR*1): Thickness Reduction Rate/Accumulated Thickness Reduction Rate in Recrystallization Range

TABLE 10

| Samples | Ratios of Alloying Elements after Nitrogenizing Treatment Capable of Obtaining Effects of The Invention | | | | | |
|---|---|---|---|---|---|---|
| | Ti/N | Zr/N | N/B | Al/N | V/N | (Ti + Zr + 2Al + 4B + V)/N |
| Present Sample 1 | 1.3 | 1.0 | 15.0 | 3.8 | 1.0 | 11.1 |
| Present Sample 2 | 1.2 | 0.9 | 16.4 | 3.5 | 0.9 | 10.1 |
| Present Sample 3 | 1.2 | 0.8 | 17.1 | 3.3 | 0.8 | 9.7 |
| Comparative sample 1 | 2.9 | 2.1 | 6.9 | 8.3 | 2.1 | 24.3 |
| Comparative Sample 2 | 0.3 | 0.2 | 60 | 1.0 | 0.2 | 2.8 |
| Present Sample 4 | 1.8 | 0.7 | 28.0 | 2.5 | 0.4 | 8.1 |
| Present Sample 5 | 1.4 | 0.9 | 36.7 | 5.5 | 1.8 | 14.8 |
| Present Sample 6 | 2.5 | 1.3 | 16.0 | 2.5 | 6.3 | 15.3 |
| Present Sample 7 | 1.7 | 0.7 | 20.0 | 3.0 | 1.7 | 10.2 |
| Present Sample 8 | 2.0 | 1.0 | 10.0 | 2.5 | 9.0 | 17.4 |
| Present Sample 9 | 1.3 | 0.9 | 14.4 | 3.5 | 1.7 | 11.1 |
| Present Sample 10 | 1.5 | 0.4 | 12.0 | 5.0 | 0.8 | 13.1 |
| Present Sample 11 | 2.2 | 1.1 | 22.5 | 2.8 | 2.2 | 11.3 |
| Present Sample 12 | 2.5 | 0.5 | 16.7 | 4.5 | 2.0 | 14.2 |
| Present Sample 13 | 1.4 | 0.4 | 12.0 | 3.6 | — | 9.3 |
| Conventional Steel 1 | 4.1 | 4.1 | 13.8 | 0.6 | — | 5.7 |
| Conventional Steel 2 | 2.5 | 2.5 | 96.0 | 0.8 | — | 4.0 |
| Conventional Steel 3 | 0.8 | 0.8 | 105.8 | 0.4 | — | 1.5 |

TABLE 10-continued

| Samples | Ratios of Alloying Elements after Nitrogenizing Treatment Capable of Obtaining Effects of The Invention | | | | | |
|---|---|---|---|---|---|---|
| | Ti/N | Zr/N | N/B | Al/N | V/N | (Ti + Zr + 2Al + 4B + V)/N |
| Conventional Steel 4 | 4.1 | 4.1 | 4.0 | 0.8 | 8.8 | 15.5 |
| Conventional Steel 5 | 6.5 | 6.5 | 4.0 | 1.1 | 18.5 | 28.1 |
| Conventional Steel 6 | 3.2 | 3.2 | 2.6 | 0.4 | 16.1 | 21.6 |
| Conventional Steel 7 | 1.0 | 1.0 | 9.9 | 2.5 | — | 6.5 |
| Conventional Steel 8 | 1.2 | 1.2 | 14.3 | 0.4 | — | 2.2 |
| Conventional Steel 9 | 0.8 | 0.8 | 9.1 | 2.1 | 3.9 | 9.2 |
| Conventional Steel 10 | 0.6 | 0.6 | 9.5 | 3.2 | 1.5 | 8.9 |
| Conventional Steel 11 | 5.5 | 5.5 | 12.7 | 3.4 | 7.8 | 20.3 |

Test pieces were sampled from the hot-rolled steel plates manufactured as described above. The sampling was performed at the central portion of each rolled product in a thickness direction. In particular, test pieces for a tensile test were sampled in a rolling direction, whereas test pieces for a Charpy impact test were sampled in a direction perpendicular to the rolling direction.

Using steel test pieces sampled as described above, characteristics of precipitates in each steel product (matrix), and mechanical properties of the steel product were measured. The results are described in Table 11. Also, the microstructure and impact toughness of the heat affected zone were measured. The results are described in Table 12. These measurements were carried out in the same fashion as in Example 1.

TABLE 11

| Sample | Characteristics of Precipitates of TiN | | | Characteristics of Matrix Structure | | Volume Fraction of Ferrite (%) | Mechanical Properties of Matrix | | | | |
|---|---|---|---|---|---|---|---|---|---|---|---|
| | Density (number/mm$^2$) | Mean Size (μm) | Spacing (μm) | AGS | FGS | | Thickness (mm) | Yield Strength (MPa) | Tensile Strength (MPa) | Elongation (%) | Impact Toughness at −40° C. (J) |
| Present Sample 1 | $2.3 \times 10^8$ | 0.016 | 0.26 | 17 | 6 | 92 | 20 | 454 | 573 | 35 | 364 |
| Present Sample 2 | $3.1 \times 10^8$ | 0.017 | 0.26 | 15 | 5 | 94 | 20 | 395 | 581 | 36 | 355 |
| Present Sample 3 | $2.5 \times 10^8$ | 0.012 | 0.24 | 13 | 4 | 93 | 20 | 396 | 580 | 36 | 358 |
| Comparative Sample 1 | $4.3 \times 10^6$ | 0.154 | 1.4 | 38 | 27 | 70 | 20 | 393 | 584 | 28 | 212 |
| Comparative Sample 2 | $5.4 \times 10^6$ | 0.155 | 1.5 | 34 | 23 | 75 | 20 | 392 | 580 | 29 | 189 |
| Present Sample 4 | $3.2 \times 10^8$ | 0.025 | 0.35 | 15 | 6 | 93 | 25 | 396 | 588 | 35 | 358 |
| Present Sample 5 | $2.6 \times 10^8$ | 0.013 | 0.32 | 14 | 6 | 92 | 25 | 396 | 582 | 35 | 349 |
| Present Sample 6 | $3.3 \times 10^8$ | 0.026 | 0.42 | 15 | 6 | 94 | 25 | 390 | 583 | 35 | 358 |
| Present Sample 7 | $4.6 \times 10^8$ | 0.024 | 0.45 | 16 | 5 | 93 | 30 | 390 | 584 | 35 | 346 |

TABLE 11-continued

| Sample | Characteristics of Precipitates of TiN: Density (number/mm$^2$) | Mean Size ($\mu$m) | Spacing ($\mu$m) | Characteristics of Matrix Structure: AGS | FGS | Volume Fraction of Ferrite (%) | Mechanical Properties of Matrix: Thickness (mm) | Yield Strength (MPa) | Tensile Strength (MPa) | Elongation (%) | Impact Toughness at −40° C. (J) |
|---|---|---|---|---|---|---|---|---|---|---|---|
| Present Sample 8 | $4.3 \times 10^8$ | 0.014 | 0.35 | 15 | 6 | 92 | 30 | 392 | 582 | 36 | 352 |
| Present Sample 9 | $5.6 \times 10^8$ | 0.028 | 0.36 | 15 | 6 | 91 | 30 | 391 | 586 | 36 | 348 |
| Present Sample 10 | $5.2 \times 10^8$ | 0.021 | 0.35 | 15 | 8 | 92 | 30 | 394 | 586 | 35 | 358 |
| Present Sample 11 | $3.7 \times 10^8$ | 0.029 | 0.29 | 14 | 7 | 94 | 35 | 390 | 596 | 36 | 362 |
| Present Sample 12 | $3.2 \times 10^8$ | 0.025 | 0.25 | 16 | 8 | 93 | 35 | 396 | 582 | 35 | 347 |
| Present Sample 13 | $3.2 \times 10^8$ | 0.024 | 0.34 | 15 | 6 | 87 | 35 | 387 | 568 | 36 | 362 |
| Conventional Steel 1 | | | | | | | 35 | 406 | 436 | — | |
| Conventional Steel 2 | | | | | | | 35 | 405 | 441 | — | |
| Conventional Steel 3 | | | | | | | 25 | 629 | 681 | — | |
| Conventional Steel 4 | Precipitates of MgO-TiN $3.03 \times 10^6$/mm$^2$ | | | | | | 40 | 472 | 609 | 32 | |
| Conventional Steel 5 | Precipitates of MgO-TiN $4.07 \times 10^6$/mm$^2$ | | | | | | 40 | 494 | 622 | 32 | |
| Conventional Steel 6 | Precipitates of MgO-TiN $2.80 \times 10^6$/mm$^2$ | | | | | | 50 | 812 | 912 | 28 | |
| Conventional Steel 7 | | | | | | | 25 | 629 | 681 | — | |
| Conventional Steel 8 | | | | | | | 50 | 504 | 601 | — | |
| Conventional Steel 9 | | | | | | | 60 | 526 | 648 | — | |
| Conventional Steel 10 | | | | | | | 60 | 760 | 829 | — | |
| Conventional Steel 11 | 0.2 $\mu$m or less | $11.1 \times 10^3$ | | | | | 50 | 401 | 514 | 18.3 | |

Referring to Table 11, it can be seen that the density of precipitates (TiN precipitates) in each hot-rolled product manufactured in accordance with the present invention is $1.0\times10^8$/mm$^2$ or more, whereas the density of precipitates in each conventional product is $4.07\times10^5$/mm$^2$ or less.

It was also found that ZrN precipitates having a grain size of 50 to 100 nm exist in the products of the present invention. Also, the products of the present invention had a matrix structure in which fine ferrite has a high fraction.

TABLE 12

| Sample | Grain Size of Austenite in Heat Affected Zone ($\mu$m): 1,200 (° C.) | 1,300 (° C.) | 1400 (° C.) | Microstructure of Heat Affected Zone with Heat Input of 100 kJ/cm: Volume Fraction of Ferrite (%) | Mean Grain Size of Ferrite ($\mu$m) | Mechanical Properties of Welded Zone: $\Delta t_{800-500}$ = 180 sec Yield Strength (kg/mm$^2$) | Tensile Strength (kg/mm$^2$) | Reproducible Heat Affected Zone Impact Toughness (J) at −40° C. (Maximum Heating Temp. 1,400° C.): $\Delta t_{800-500}$ = 120 sec Impact Toughness (J) | Transition Temp. (° C.) | $\Delta t_{800-500}$ = 180 sec Impact Toughness (J) | Transition Temp. (° C.) |
|---|---|---|---|---|---|---|---|---|---|---|---|
| PS 1 | 23 | 33 | 56 | 73 | 16 | 370 | −74 | 330 | −67 | 294 | −62 |
| PS 2 | 22 | 34 | 55 | 76 | 15 | 383 | −76 | 353 | −69 | 301 | −63 |

TABLE 12-continued

| | Grain Size of Austenite in Heat Affected Zone (μm) | | | Microstructure of Heat Affected Zone with Heat Input of 100 kJ/cm | | Mechanical Properties of Welded Zone | | Reproducible Heat Affected Zone Impact Toughness (J) at −40° C. (Maximum Heating Temp. 1,400° C.) | | | |
|---|---|---|---|---|---|---|---|---|---|---|---|
| | | | | Volume Fraction of | Mean Grain Size of | $\Delta t_{800-500}$ = 180 sec | | $\Delta t_{800-500}$ = 120 sec | | $\Delta t_{800-500}$ = 180 sec | |
| Sample | 1,200 (° C.) | 1,300 (° C.) | 1400 (° C.) | Ferrite (%) | Ferrite (μm) | Yield Strength (kg/mm²) | Tensile Strength (kg/mm²) | Impact Toughness (J) | Transition Temp. (° C.) | Impact Toughness (J) | Transition Temp. (° C.) |
| PS 3 | 23 | 32 | 56 | 74 | 17 | 365 | −72 | 331 | −67 | 298 | −63 |
| CS 1 | 54 | 84 | 182 | 36 | 32 | 126 | −43 | 47 | −34 | 26 | −27 |
| CS 2 | 65 | 91 | 198 | 37 | 35 | 104 | −40 | 35 | −32 | 18 | −26 |
| PS 4 | 25 | 37 | 65 | 75 | 18 | 353 | −71 | 325 | −68 | 287 | −64 |
| PS 5 | 26 | 40 | 57 | 74 | 16 | 362 | −71 | 333 | −67 | 296 | −61 |
| PS 6 | 25 | 31 | 53 | 76 | 17 | 386 | −73 | 353 | −69 | 305 | −62 |
| PS 7 | 24 | 34 | 55 | 74 | 18 | 367 | −71 | 338 | −67 | 293 | −63 |
| PS 8 | 27 | 36 | 53 | 73 | 14 | 364 | −71 | 334 | −67 | 294 | −61 |
| PS 9 | 24 | 36 | 52 | 74 | 17 | 367 | −72 | 335 | −67 | 285 | −62 |
| PS 10 | 22 | 35 | 53 | 73 | 18 | 385 | −72 | 345 | −66 | 294 | −61 |
| PS 11 | 26 | 34 | 64 | 74 | 16 | 358 | −71 | 324 | −68 | 285 | −63 |
| PS 12 | 27 | 38 | 64 | 74 | 18 | 355 | −71 | 324 | −67 | 284 | −62 |
| PS 13 | 24 | 32 | 54 | 75 | 16 | 367 | −72 | 336 | −68 | 285 | −63 |
| CS* 1 | | | | | | 187 | −51 | | | | |
| CS* 2 | | | | | | 156 | −48 | | | | |
| CS* 3 | | | | | | 148 | −50 | | | | |
| CS* 4 | | 230 | | 93 | | 143 | −48 | | | 132(0° C.) | |
| CS* 5 | | 180 | | 87 | | 132 | −45 | | | 129(0° C.) | |
| CS* 6 | | 250 | | 47 | | 153 | −43 | | | 60(0° C.) | |
| CS* 7 | | | | | | 141 | −54 | | | | −61 |
| CS* 8 | | | | | | 156 | −59 | | | | −48 |
| CS* 9 | | | | | | 145 | −54 | | | | −42 |
| CS* 10 | | | | | | 138 | −57 | | | | −45 |
| CS* 11 | | | | | | 141 | −43 | 219(0° C.) | | | |

PS: Present Sample
CS: Comparative Sample
CS*: Conventional Steel

PS: Present
CS: Comparative Sample
CS*: Conventional Steel

Referring to Table 12, it can be seen that the size of austenite grains under a maximum heating temperature of 1,400° C., as in the heat affected zone, is within a range of 52 to 64 μm in the case of the present invention, whereas the austenite grains in the conventional products are very coarse to have a grain size of about 180 μm. Thus, the steel products of the present invention have a superior effect of suppressing the growth of austenite grains at the heat affected zone in a welding process., as compared to the conventional steels.

Where a welding process using a heat input of 100 kJ/cm is applied, the steel products of the present invention have a ferrite fraction of about 70% or more.

What is claimed is:

1. A weldable structural steel product having TiN and ZrN precipitates, comprising, in terms of percent by weight, 0.03 to 0.17% C, 0.01 to 0.5% Si, 0.4 to 2.0% Mn, 0.005 to 0.2% Ti, 0.0005 to 0.1% Al, 0.001 to 0.03% Zr, 0.008 to 0.030% N, 0.0003 to 0.01% B, 0.001 to 0.2% W, at most 0.03% P, at most 0.03% S, at most 0.01% O, and balance Fe and incidental impurities while satisfying conditions of $1.2 \leqq Ti/N \leqq 2.5$, $0.3 \leqq Zr/N \leqq 2.0$, $10 \leqq N/B \leqq 40$, $2.5 \leqq Al/N \leqq 7$, and $6.8 \leqq (Ti+Zr+2Al+4B)/N \leqq 17$, and having a microstructure essentially consisting of a complex structure of ferrite and pearlite having a grain size of 20 μm or less, wherein said ZrN precipitates and TiN precipitates having a grain size of 0.01 to 1 μm are dispersed at a density of $1.0 \times 10^7/mm^2$ or more and a spacing of 0.5 μm or less.

2. The welding structural steel product according to claim 1, further comprising 0.01 to 0.2% V while satisfying conditions of $0.3 \leqq V/N \leqq 9$, and $7 \leqq (Ti+2Al+4B\ V)/N \leqq 17$.

3. The welding structural steel product according to claim 1, further comprising one or more selected from a group consisting of Ni: 0.1 to 3.0%, Cu: 0.1 to 1.5%, Nb: 0.01 to 0.1%, Mo: 0.05 to 1.0%, and Cr: 0.05 to 1.0%.

4. The welding structural steel product according to claim 1, further comprising one or both of Ca: 0.0005 to 0.005% and REM: 0.005 to 0.05%.

5. The welding structural steel product according to claim 1, wherein when a toughness difference between the steel product and a heat treated zone, exhibited when the steel product is heated to a temperature of 1,400° C. or more, and then cooled within 60 seconds over a cooling range of from 800° C. to 500° C., is within a range of ±30 J, when a toughness difference between the steel product and the heat treated zone, exhibited when the steel product is heated to a temperature of 1,400° C. or more, and then cooled within 60 to 120 seconds over a cooling range of from 800° C. to 500° C., is within a range of 0 to 40 J, and when a toughness difference between the steel product and the heat treated zone, exhibited when the steel product is heated to a temperature of 1,400° C. or more, and then cooled within 120 to 180 seconds over a cooling range of from 800° C. to 500° C., is within a range of 0 to 105 J.

6. A method for manufacturing a welding structural steel product having fine complex precipitates of TiN and ZrN, comprising the steps of:

preparing a steel slab containing, in terms of percent by weight, 0.03 to 0.17% C, 0.01 to 0.5% Si, 0.4 to 2.0% Mn, 0.005 to 0.2% Ti, 0.0005 to 0.1% Al, 0.001 to 0.03% Zr, 0.008 to 0.030% N, 0.0003 to 0.01% B, 0.001 to 0.2% W, at most 0.03% P, at most 0.03% S, at most 0.001% O, and balance Fe and incidental impurities while satisfying conditions of $1.2 \leqq Ti/N \leqq 2.5$, $0.3 \leqq Zr/N \leqq 2.0$, $10 \leqq N/B \leqq 40$, $2.5 \leqq Al/N \leqq 7$, and $6.8 \leqq (Ti+Zr+2Al+4B)/N \leqq 17$;

heating the steel slab at a temperature ranging from 1,100° C. to 1,250° C. for 60 to 180 minutes;

hot rolling the heated steel slab in an austenite recrystallization range at a thickness reduction rate of 40% or more; and cooling the hot-rolled steel slab at a rate of 1° C./min to a temperature corresponding to ±10° C. from a ferrite transformation finish temperature; wherein ZrN precipitates and TIN precipitates having a grain size of 0.01 to 0.1 μm are dispersed at a density of $1.0\times10^7/mm^2$ or more and a spacing of 0.5 μm or less.

7. The method according to claim 6, wherein the slab further contains 0.01 to 0.2% V while satisfying conditions of $0.3 \leqq V/N \leqq 9$, and $7 \leqq (Ti+2Al+4B+V)/N \leqq 17$.

8. The method according to claim 6, wherein the slab further contains one or more selected from a group consisting of Ni: 0.1 to 3.0%, Cu: 0.1 to 1.5%, Nb: 0.01 to 0.1%, Mo: 0.05 to 1.0%, and Cr: 0.05 to 1.0%.

9. The method according to claim 6, wherein the slab further contains one or both of Ca: 0.0005 to 0.005% and REM: 0.005 to 0.05%.

10. The method according to claim 1, wherein the preparation of the slab is carried out by adding, to molten steel, a deoxidizing element having a deoxidizing effect higher than that of Ti, thereby controlling the molten steel to have a dissolved oxygen amount of 30 ppm or less, adding, within 10 minutes, Ti to have a content of 0.005 to 0.02%, and casting the resultant slab.

11. The method according to claim 10, wherein the deoxidation is carried out in the order of Mn, Si, and Al.

12. The method according to claim 10, wherein the molten steel is cast at a speed of 0.9 to 1.1 m/min in accordance with a continuous casting process while being weak cooled at a secondary cooling zone with a water spray amount of 0.3 to 0.35 l/kg.

13. A method for manufacturing a welding structural steel product having fine complex precipitates of TiN and ZrN, comprising the steps of:

preparing a steel slab containing, in terms of percent by weight, 0.03 to 0.17% C, 0.01 to 0.5% Si, 0.4 to 2.0% Mn, 0.005 to 0.2% Ti, 0.0005 to 0.1% Al, 0.001 to 0.03% Zr, at most 0.005% N, 0.0003 to 0.01% B, 0.001 to 0.2% W, at most 0.03% P, 0.003 to 0.05% S, at most 0.01% O, and balance Fe and incidental impurities;

heating the steel slab at a temperature ranging from 1,000° C. to 1,250° C. for 60 to 180 minutes while nitrogenizing the steel slab to control the N content of the steel slab to be 0.008 to 0.03%, and to satisfy conditions of $1.2 \leqq Ti/N \leqq 2.5$, $0.3 \leqq Zr/N \leqq 2$, $10 \leqq N/B \leqq 40$, $2.5 \leqq Al/N \leqq 7$, and $6.8 \leqq (Ti+Zr+2Al+4B)/N \leqq 17$;

hot rolling the nitrogenized steel slab in an austenite recrystallization range at a thickness reduction rate of 40% or more; and cooling the hot-rolled steel slab at a rate of 1° C./min to a temperature corresponding to ±10° C. from a ferrite transformation finish temperature, wherein ZrN precipitates and TiN precipitates having a grain size of 0.01 to 0.1 μm are dispersed at a density of $1.0\times10^7/mm^2$ or more and a spacing of 0.5 μm or less.

14. The method according to claim 13, wherein the slab further contains 0.01 to 0.2% V while satisfying conditions of $0.3 \leqq V/N \leqq 9$, and $7 \leqq (Ti+2Al+4B+V)/N \leqq 17$.

15. The method according to claim 13, wherein the slab further contains one or more selected from a group consisting of Ni: 0.1 to 3.0%, Cu: 0.1 to 1.5%, Nb: 0.01 to 0.1%, Mo: 0.05 to 1.0%, and Cr: 0.05 to 1.0%.

16. The method according to claim 13, wherein the slab further contains one or both of Ca: 0.0005 to 0.005% and REM: 0.005 to 0.05%.

17. The method according to claim 13, wherein the preparation of the slab is carried out by adding, to molten steel, a deoxidizing element having a deoxidizing effect higher than that of Ti, thereby controlling the molten steel to have a dissolved oxygen amount of 30 ppm or less, adding, within 10 minutes, Ti to have a content of 0.005 to 0.02%, and casting the resultant slab.

18. The method according to claim 17, wherein the deoxidation is carried out in the order of Mn, Si, and Al.

19. A welded structure having a superior heat affected zone toughness, manufactured using a weldable structural steel product having TiN and ZrN precipitates, comprising, in terms of percent by weight, 0.03 to 0.17% C, 0.01 to 0.5% Si, 0.4 to 2.0% Mn, 0.005 to 0.2% Ti, 0.0005 to 0.1% Al, 0.001 to 0.03% Zr, 0.008 to 0.030% N, 0.0003 to 0.01% B, 0.001 to 0.2% W, at most 0.03% P, at most 0.03% S, at most 0.01% O, and balance Fe and incidental impurities while satisfying conditions of $1.2 \leqq Ti/N \leqq 2.5$, $0.3 \leqq Zr/N \leqq 2.0$, $10 \leqq N/B \leqq 40$, $2.5 \leqq Al/N \leqq 7$, $6.8 \leqq (Ti+Zr+2Al+4B)/N \leqq 17$, and having a microstructure essentially consisting of a complex structure of ferrite and pearlite having a grain size of 20 μm or less, and wherein ZrN precipitates and TiN precipitates having a grain size of 0.01 to 0.1 μm are dispersed at a density of $1.0\times10^7/mm^2$ or more and a spacing of 0.5 μm or less.

20. The welded structure of claim 19, wherein the weldable structural steel product further comprises: 0.01 to 0.2% V while satisfying conditions of $0.3 \leqq V/N \leqq 9$, and $7 \leqq (Ti+2Al+4B+V)/N \leqq 17$.

21. The welded structure of claim 19, wherein the weldable structural steel product further comprises one or more selected from a group consisting of Ni: 0.1 to 3.0%, Cu: 0.1 to 1.5%, Nb: 0.01 to 0.1%, Mo: 0.05 to 1.0%, and Cr: 0.05 to 1.0%.

22. The welded structure of claim 19, wherein the weldable structural steel product further comprises one or both of Ca: 0.0005 to 0.005% and REM: 0.005 to 0.05%.

23. The welded structure of claim 19, wherein when a toughness difference between the steel product and a heat treated zone, exhibited when the steel product is heated to a temperature of 1,400° C. or more, and then cooled within 60 seconds over a cooling range of from 800° C. to 500° C., is within a range of ±30 J, when a toughness difference between the steel product and the heat treated zone, exhibited when the steel product is heated to a temperature of 1,400° C. or more, and then cooled within 60 to 120 seconds over a cooling range of from 800° C. to 500° C., is within a range of 0 to 40 J, and when a toughness difference between the steel product and the heat treated zone, exhibited when the steel product is heated to a temperature of 1,400° C. or more, and then cooled within 120 to 180 seconds over a cooling range of from 800° C. to 500° C., is within a range of 0 to 105 J.

* * * * *

UNITED STATES PATENT AND TRADEMARK OFFICE

CERTIFICATE OF CORRECTION

PATENT NO. : 6,966,955 B2
DATED : November 22, 2005
INVENTOR(S) : Choi et al.

It is certified that error appears in the above-identified patent and that said Letters Patent is hereby corrected as shown below:

Column 2,
Line 58, delete "DISCLOSURE OF THE INVENTION".

Column 3,
Lines 62-63, delete "BEST MODE FOR CARRYING OUT THE INVENTION".

Column 36,
Line 41, "0.01 to 1" should read -- 0.01 to 0.1 --.
Lines 43, 46, 49 and 52, "The welding structural steel" should read -- The weldable structural steel --.
Line 65, "a welding structural steel" should read -- a weldable structural steel --.

Column 37,
Line 44, "a welding structural steel" should read -- a weldable structural steel --.

Signed and Sealed this

Thirtieth Day of May, 2006

JON W. DUDAS
*Director of the United States Patent and Trademark Office*